US011381018B2

(12) United States Patent
Manba

(10) Patent No.: US 11,381,018 B2
(45) Date of Patent: Jul. 5, 2022

(54) CONNECTOR, CONNECTION OBJECT AND ELECTRONIC DEVICE

(71) Applicant: KYOCERA CORPORATION, Kyoto (JP)

(72) Inventor: Yousuke Manba, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 83 days.

(21) Appl. No.: 16/346,075

(22) PCT Filed: Nov. 1, 2018

(86) PCT No.: PCT/JP2018/040748

§ 371 (c)(1),
(2) Date: Apr. 29, 2019

(87) PCT Pub. No.: WO2019/088233

PCT Pub. Date: May 9, 2019

(65) Prior Publication Data

US 2021/0359449 A1 Nov. 18, 2021

(30) Foreign Application Priority Data

Nov. 1, 2017 (JP) ..... JP2017-211826

(51) Int. Cl.

| | |
|---|---|
| ***H01R 12/88*** | (2011.01) |
| ***H01R 12/70*** | (2011.01) |
| ***H01R 12/79*** | (2011.01) |
| ***H01R 13/629*** | (2006.01) |
| ***H01R 13/639*** | (2006.01) |

(52) U.S. Cl.
CPC ..... *H01R 12/88* (2013.01); *H01R 12/7011* (2013.01); *H01R 12/79* (2013.01); *H01R 13/629* (2013.01); *H01R 13/639* (2013.01)

(58) Field of Classification Search
CPC .. H01R 23/684; H01R 12/88; H01R 12/7011; H01R 12/79; H01R 13/629; H01R 13/639
USPC ..... 439/260, 329
See application file for complete search history.

(56) References Cited

U.S. PATENT DOCUMENTS 5,173,058 A * 12/1992 Broeksteeg ..... H01R 13/193 439/267
7,270,567 B2 * 9/2007 Inoue ..... H01R 12/79 439/260

(Continued)

FOREIGN PATENT DOCUMENTS

CN 101203990 A 6/2008
JP 2512531 Y2 7/1996

(Continued)

*Primary Examiner* — Gary F Paumen
(74) *Attorney, Agent, or Firm* — Duane Morris LLP

(57) ABSTRACT

A connector (10) according to this disclosure includes an insulator (20) into/from which a connection object (60) can be inserted/removed and an actuator (50) capable of rotating between a closed position where the actuator closes relative to the insulator (20) and an opened position where the actuator opens relative to the insulator (20). The actuator (50) rotates from the removal side to the insertion side of the connection object (60) with respect to the insulator (20) when moving from the closed position to the opened position and holds the opened position independently.

6 Claims, 20 Drawing Sheets

(56) References Cited

U.S. PATENT DOCUMENTS

| | | | | |
|---|---|---|---|---|
| 7,789,688 | B2 * | 9/2010 | Hemmi | H01R 12/771 439/260 |
| 8,182,277 | B2 * | 5/2012 | Yokoo | H01R 12/88 439/260 |
| 8,851,914 | B2 * | 10/2014 | Lin | H01R 13/62933 439/260 |
| 10,381,763 | B2 | 8/2019 | Ikegami | |
| 2008/0254662 | A1 * | 10/2008 | Koga | H01R 12/79 439/260 |
| 2009/0318001 | A1 | 12/2009 | Hemmi et al. | |
| 2017/0331211 | A1 | 11/2017 | Nakajima et al. | |
| 2018/0248288 | A1 | 8/2018 | Ikegami | |
| 2018/0323546 | A1 | 11/2018 | Ikegami et al. | |

FOREIGN PATENT DOCUMENTS

| | | | |
|---|---|---|---|
| JP | 2016-62851 | A | 4/2016 |
| JP | 2017097996 | A | 6/2017 |
| WO | 2017033382 | A1 | 3/2017 |

* cited by examiner

CONNECTOR, CONNECTION OBJECT AND ELECTRONIC DEVICE

CROSS-REFERENCE TO RELATED APPLICATION

This application claims priority to and the benefit of Japanese Patent Application No. 2017-211826 filed on Nov. 1, 2017, the entire contents of which are incorporated herein by reference.

TECHNICAL FIELD

The present disclosure relates to a connector, a connection object and an electronic device.

BACKGROUND

Conventionally, in view of improvement of usability, a structure that allows for easy insertion and removal of a connection object is required for a connector used for an electronic device and the like. When all processes are performed automatically by machines without using hand for manufacture of electronic devices, and when connectors are inserted and removed by hand for maintenance of devices, there is an increased demand for improvement of usability of the connectors.

For example, in a connector for cable disclosed in patent literature 1 (PTL 1), a connector for cable and a connection object are securely connected to each other by one operation of inserting a connection object.

CITATION LIST

Patent Literature

PTL 1: JP2016-062851 A

SUMMARY

Solution to Problem

A connector according to an embodiment of this disclosure includes:

an insulator into/from which a connection object can be inserted/removed; and an actuator capable of rotating between a closed position where the actuator closes with respect to the insulator and an opened position where the actuator opens with respect to the insulator, wherein the actuator rotates from a removal side to an insertion side of the connection object with respect to the insulator when moving from the closed position to the opened position and holds the opened position independently.

DETAILED DESCRIPTION

In a connector for cable disclosed in PTL 1, although usability is improved when a connection object is inserted, usability for removing a connection object is not considered.

In a connector according to an embodiment of this disclosure, usability for removing a connection object is improved.

An embodiment according to this disclosure will be described in detail below with reference to the appended drawings. Hereinafter, front and back, right and left and up and down directions are based on the arrows in each drawing. The direction of each arrow is common to all drawings from FIG. 1 to FIG. 32. For simplified illustration, illustration of a circuit board CB is omitted in some drawings.

An connection object 60 connected to a connector 10 according to an embodiment is described as a flexible printed circuit board (FPC), for example, but not limited thereto. Any connection object 60 may be used as far as it can be electrically connected to a circuit board CB through the connector 10. For example, the connection object 60 may be a flexible flat cable (FFC).

Hereinafter, an explanation is given as the connection object 60 is connected to the connector 10 vertical to a circuit board CB on which the connector 10 is mounted. As an example, the connection object 60 is connected to the connector 10 along the up/down direction. The "insertion/removal direction" used below refers to the up/down direction as an example. The "removal direction" refers to the up direction as an example. The "insertion side" refers to the down side. The "removal side" refers to the up side. The connection method is not limited thereto. The connection object 60 may be connected to the connector 10 in a direction parallel to the circuit board CB. The circuit board CB may be a rigid board or any other circuit boards.

Figure 1:
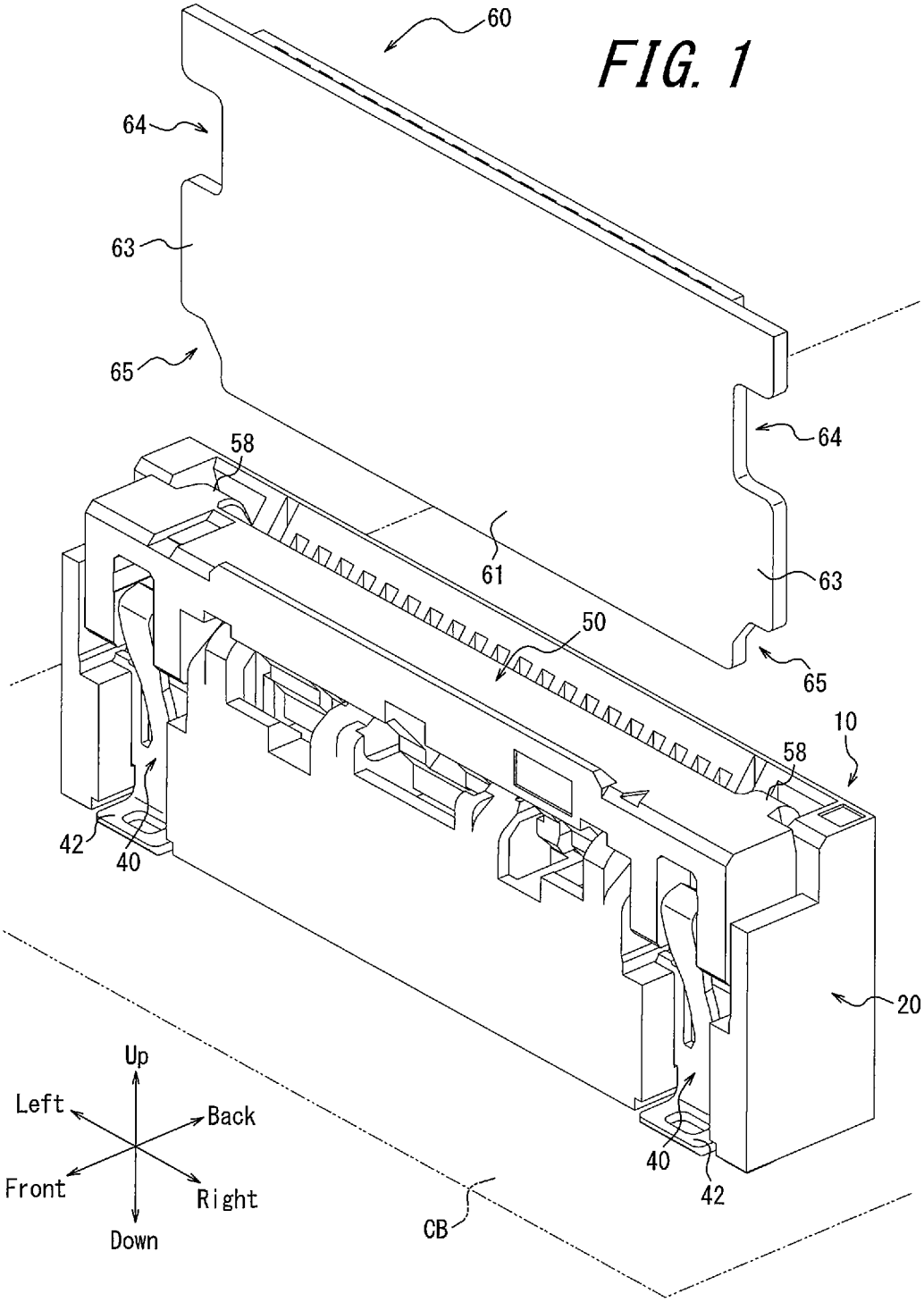
FIG. 1 is a perspective front view illustrating a connector and a connection object according to an embodiment in a separation state.
Figure 2:
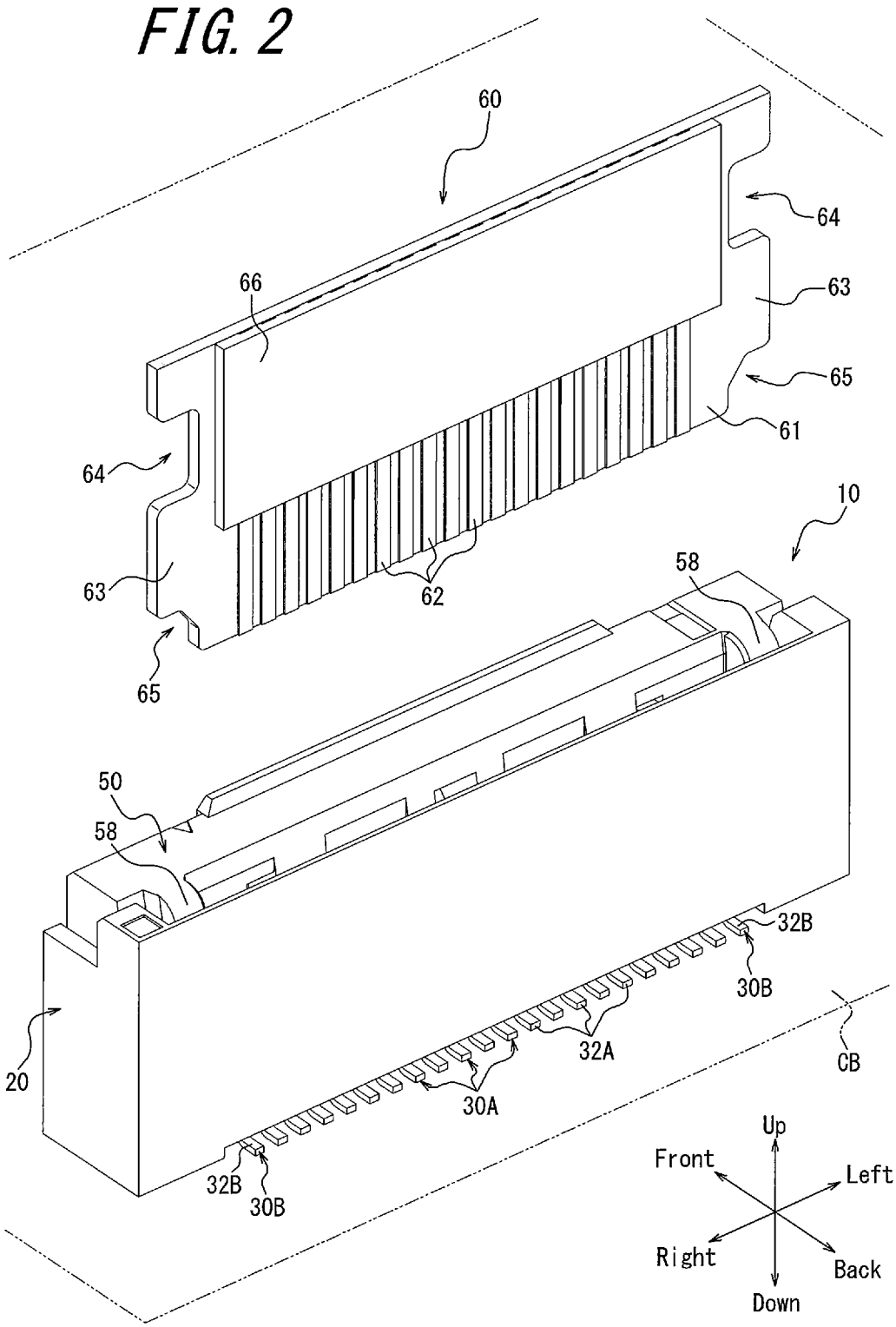
FIG. 2 is a perspective back view illustrating the connector and the connection object in FIG. 1 in a separation state.
Figure 3:
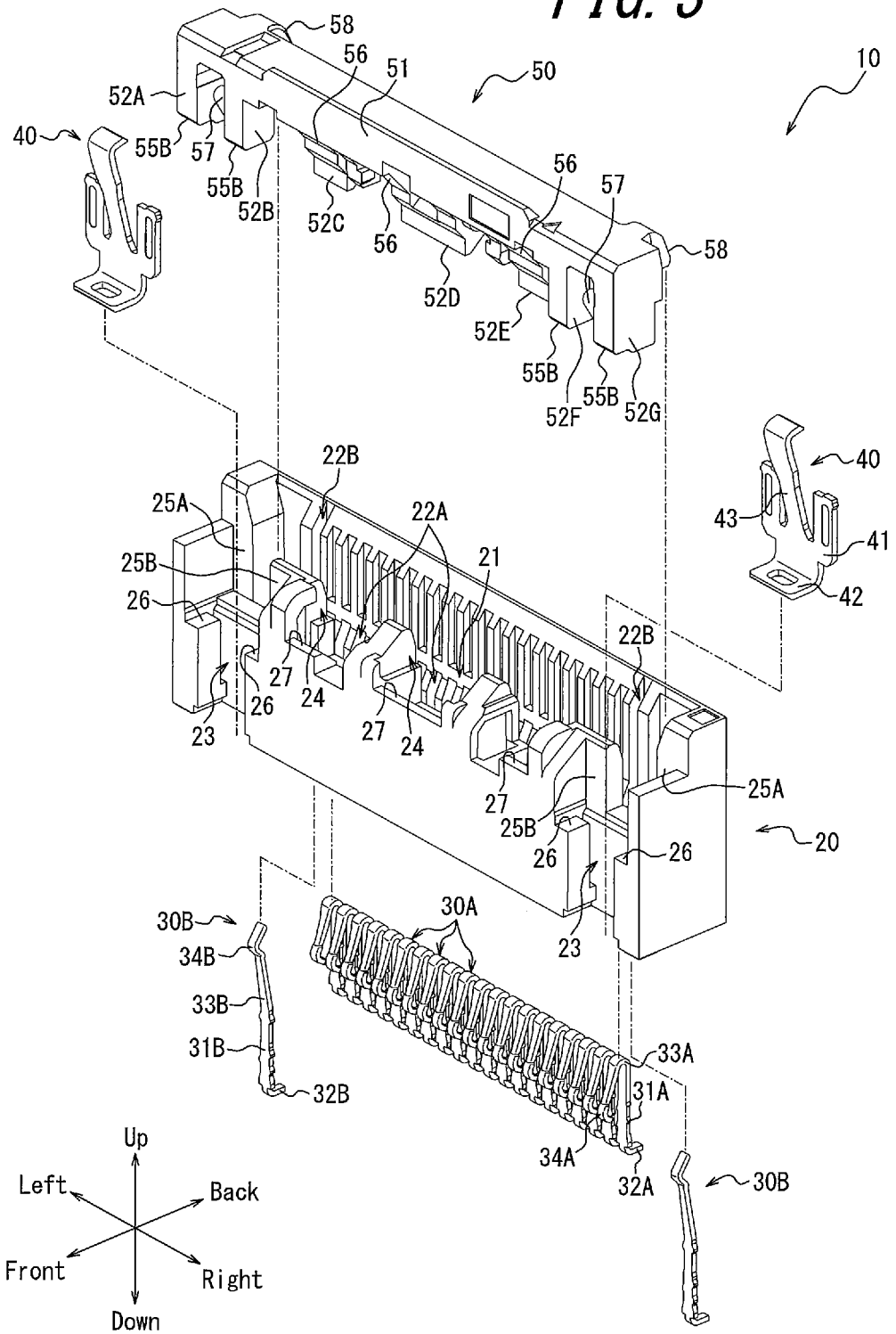
FIG. 3 is an exploded front perspective view of the connector in FIG. 1.
Figure 4:
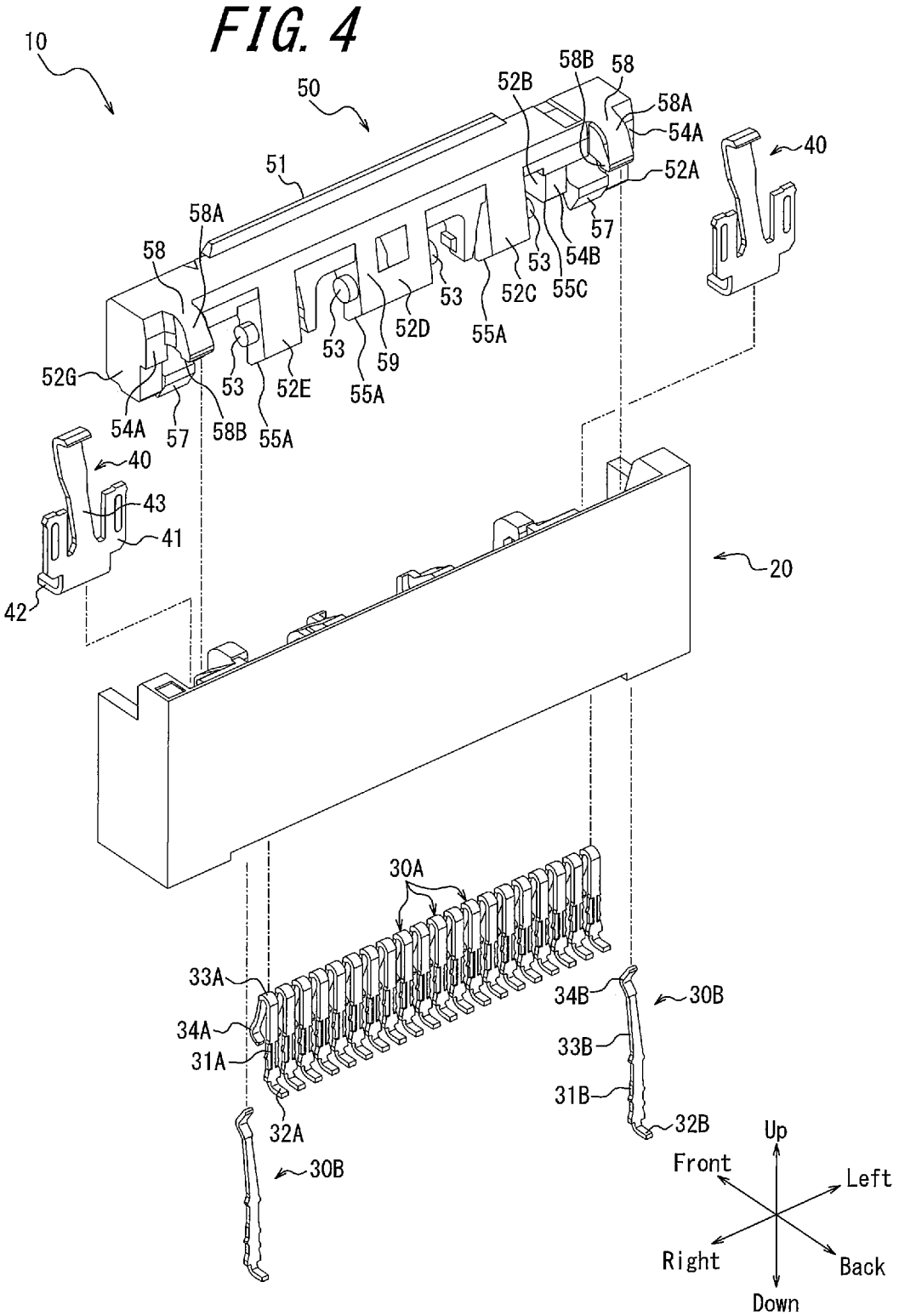
FIG. 4 is an exploded back perspective view of the connector in FIG. 1.

FIG. 1 is a perspective front view illustrating the connector 10 and the connection object 60 according to an embodiment in a separation state. FIG. 2 is a perspective back view illustrating the connector 10 and the connection object 60 in FIG. 1 in a separation state. FIG. 3 is an exploded front perspective view of the connector 10 in FIG. 1. FIG. 4 is an exploded back perspective view of the connector 10 in FIG. 1. Configuration of the connector 10 and the connection object 60 according to an embodiment will be described in detail below with reference to FIGS. 1 to 4.

With reference to FIGS. 3 and 4, the connector 10 according to an embodiment has, as large components, an insulator 20, a first contact 30A, a second contact 30B, a pressing member 40 and an actuator 50. As an example, the connector 10 is assembled by the following method. The first contact 30A and the second contact 30B are pressed into the insulator 20 from underneath of the insulator 20. After the pressing member 40 is pressed into the insulator 20 from above, the actuator 50 is attached to the insulator 20 from above. Then the pressing member 40 is engaged with the actuator 50, and thus the actuator 50 is prevented from coming off upward. With reference to FIGS. 1 and 2, the connector 10 is mounted on the circuit board CB. The connector 10 electrically connects the connection object 60 and the circuit board CB through the first contact 30A and the second contact 30B.

With reference to FIG. 3, the insulator 20 is a symmetrical box member formed through injection molding of an insulating and heat-resistant synthetic resin material. The insulator 20 has an insertion groove 21 extending in the insertion/removal direction and recessed in the right/left direction. The connection object 60 is inserted into and removed from the insertion groove 21. The front upper portion of the insertion groove 21 is opened such that the actuator 50 is attached to the insulator 20. In order to improve the insertion performance of the connection object 60, the upper edge on the back surface of the insertion groove 21 is formed by a slope inclined to inside of the insertion groove 21 from the removal side to the insertion side. The substantial central portion of the insertion groove 21 in the insertion/removal direction is formed by a slope inclined further to inside of the insertion groove 21 from the removal side to the insertion side. The front-back width of the insertion groove 21 is largest at the inlet portion and is decreased in stages from the removal side toward the insertion side due to the slope.

The insulator 20 has a plurality of first mounting grooves 22A extending in the up and down direction at the lower half portion on the back surface of the insertion groove 21. A plurality of first contacts 30A is pressed into a plurality of first mounting grooves 22A, respectively. The first mounting grooves 22A are arranged separated from each other in the right and left direction at specific intervals. Each first mounting groove 22A passes through the bottom of the insulator 20 and is recessed up to the substantial central portion in the up and down direction of the insertion groove 21. The insulator 20 has second mounting grooves 22B respectively extending in the up and down direction on the right and left sides of the back surface of the insertion groove 21. A second contact 30B is pressed into each second mounting groove 22B. Each second mounting groove 22B passes through the bottom of the insulator 20 and is recessed up to the upper end of the insertion groove 21. The insulator 20 has third mounting grooves 23 respectively widely notched on the right and left ends of the front surface. A pressing member 40 is pressed into each third mounting groove 23.

The insulator 20 has rotating shaft receivers 24 at the front upper portion opened for the actuator 50 to be attached. Four rotating shaft receivers 24 are formed in total, two on the left half portion and two on the right half portion of the insulator 20. The two rotating shaft receivers 24 formed on the left half portion and those formed on the right half portion are formed substantially axisymmetric with the center of the insulator 20 in the right and left direction as a reference. The insulator 20 has first closed position regulating portions 25A that are respectively formed facing forward in the substantial central portion in the front and back direction on the right and left ends. The insulator 20 has second closed position regulating portions 25B that are respectively separated inward from the first closed position regulating portions 25A along the right and left direction and located one step in front of the first closed position regulating portions 25A. As with the first closed position regulating portions 25A, the second closed position regulating portions 25B are formed facing forward. The insulator 20 has supporting portions 26 respectively formed upward of the third mounting grooves 23 on the right and left sides. The insulator 20 has open position regulating portions 27 respectively formed discontinuously in the right and left direction at the upper edge on the front surface and facing upward.

The first contact 30A is obtained by molding a thin plate made of copper alloy including phosphor bronze, beryllium copper and titanium copper having a spring elasticity or Corson copper alloy by using a progressive die (stamping) into the shape illustrated in FIGS. 3 and 4. A surface of the first contact 30A is treated with nickel plating as an undercoat and then plated with gold or tin. A plurality of arrays of first contact 30A is disposed along the right and left direction.

Each first contact 30A has a fixing portion 31A that fixes with respect to the first mounting groove 22A of the insulator 20. Each first contact 30A has a mounting portion 32A extending from the lower end of the fixing portion 31A toward back in a substantial L-shape. Each first contact 30A has an elastically deformable elastic portion 33A that is formed continuously with the upper portion of the fixing portion 31A and bends downward after extending upward.

Each first contact 30A has a contact portion 34A located at the end thereof and formed continuously with the elastic portion 33A.

The second contact 30B is obtained by molding a thin plate made of copper alloy including phosphor bronze, beryllium copper and titanium copper having a spring elasticity or Corson copper alloy by using a progressive die (stamping) into the shape illustrated in FIGS. 3 and 4. A surface of the second contact 30B is treated with nickel plating as an undercoat and then plated with gold or tin. The second contact 30B is disposed on the right and left sides of the insulator 20.

Each second contact 30B has a fixing portion 31B that fixes with respect to the second mounting groove 22B of the insulator 20. Each second contact 30B has a mounting portion 32B extending from the lower end of the fixing portion 31B toward back in a substantial L-shape. Each second contact 30B has an elastically deformable elastic portion 33B that is formed continuously with the upper portion of the fixing portion 31B and extends upward. Each second contact 30B has a contact portion 34B located at the end thereof and formed continuously with the elastic portion 33B.

Each pressing member 40 is obtained by molding a thin plate made of any metal material into the shape illustrated in FIGS. 3 and 4 by using a progressive die (stamping). Each pressing member 40 has a fixing portion 41 fixed with respect to the third mounting groove 23 of the insulator 20. Each pressing member 40 has a mounting portion 42 extending forward from the lower end of the fixing portion 41 in a substantially L-shape. The mounting portion 42 has a through hole formed therein. The pressing member 40 has an elastically deformable elastic portion 43 extending obliquely upward from the substantial central portion of the fixing portion 41. The elastic portion 43 is formed such that its end extends in a substantial L-shape, more specifically, extends in obliquely upward, and bends backward at substantially right angle.

The actuator 50 is a symmetrical plate member extending in the right and left direction as illustrated in FIG. 3, and is obtained through injection molding of an insulating and heat-resistant synthetic resin material. The actuator 50 has an operating portion 51 that is located in the central portion and extends in the right and left direction. The actuator 50 has a projection 52 projected to the insertion side. Seven projections 52 are formed in total along the right and left direction, and projections 52A, 52B, 52C, 52D, 52E, 52F and 52G are disposed in this order from left to right.

The actuator 50 has four rotating shafts 53 in a substantially columnar shape respectively projected from the left side of the projection 52C, from both of the right and left sides of the projection 52D and from the right side of the projection 52E, along the right and left direction. The four rotating shafts 53 are aligned to each other and projected in the right and left direction. The actuator 50 has first closed position regulated portions 54A respectively formed facing backward at a projection 52A and a projection 52G. The actuator 50 has second closed position regulated portions 54B each separated inward from the first closed position regulated portion 54A along the right and left direction and located one step in front of the first closed position regulated portion 54A. The second closed position regulated portions 54B are formed backward at the projections 52B and 52F, respectively. The actuator 50 has first holding portions 55A formed of a slope inclined backward from the end of the insertion side to the removal side of the projections 52C, 52D and 52E, respectively. The actuator 50 has second holding portions 55B formed of an angle on the front side of the projections 52A, 52B, 52F and 52G, respectively. The actuator 50 has pivots 55C respectively formed of an angle on the back side of the projections 52B and 52F. The actuator 50 has position regulated portions 56 formed of a slope on the top of the projections 52C, 52D and 52E, respectively.

The actuator 50 has cams 57 each formed by being sandwiched between a pair of corresponding projections. One of the cams 57 is formed between the lower portion of the projection 52A and the lower portion of the projection 52B. The other cam 57 is formed between the lower portion of the projection 52F and the lower portion of the projection 52G. The upper edge of each cam 57 is formed by an arc-like curve. The front surface of each cam 57 is formed by a slope that is continuous with the curve of the upper edge and inclined backward from the removal side to the insertion side. The actuator 50 has hooked locking portions 58 each formed on the removal side of each cam 57. Each locking portion 58 projects backward from the upper end on the back surface of the actuator 50. Each locking portion 58 has a curve 58A forming an external surface of the removal side and curving obliquely downward after extending backward. The external surface on the removal side of the locking portion 58 has an R-shape. Each locking portion 58 has a hook 58B forming the end of the insertion side and projecting one step toward the insertion side. The actuator 50 has a pressing portion 59 formed between the locking portions 58 on both right and left sides and formed of an entire back surface that inclines backward from the removal side to the insertion side.

With reference to FIGS. 1 and 2, the connector 10 is mounted on a circuit forming surface formed on the circuit board CB disposed substantially vertical to the insertion/removal direction. More specifically, the mounting portion 32A of the first contact 30A is placed on a solder paste applied to a signal pattern on the circuit board CB. The mounting portion 32B of the second contact 30B and the mounting portion 42 of the pressing member 40 are placed on a solder paste applied to a ground pattern on the circuit board CB. Each solder paste is heated and melted by a reflow furnace and the mounting portion 32A is soldered to the signal pattern. The mounting portions 32B and 42 are soldered to the ground pattern. As a result, mounting of the connector 10 to the circuit board CB is completed. In this case, the through hole formed in the mounting portion 42 of the pressing member 40 allows the solder to be collected easily, and the fixing strength with respect to the circuit board CB is increased. At the same time the through hole formed in the mounting portion 42 prevents the excessive solder from flowing up, and as a result the spring elasticity of the elastic portion 43 is maintained.

The connection object 60 has a layered structure formed of thin films adhered to each other. The connection object 60 has a reinforcing portion 61 that forms an end in the extending direction, that is, the insertion/removal direction, and is harder than the other portions. The connection object 60 has a plurality of signal lines 62 linearly extending along the insertion/removal direction and extending to the bottom of the reinforcing portion 61. On the removal side, although the signal line 62 is covered by an exterior on the back side of the connection object 60, it is exposed backward near the end in the insertion/removal direction. The connection object 60 has contact portions 63 each formed of a side edge of the reinforcing portion 61 near the end in the insertion/removal direction. The connection object 60 has locked portions 64 each being adjacent to the contact portion 63 on the removal side and formed by cutting off the side edge of the reinforcing portion 61. The connection object 60 has guiding portions 65 each being adjacent to the contact portion 63 on the insertion side and formed by cutting off the right and left corners of the reinforcing portion 61 so as to correspond to the shape of the locking portion 58 of the actuator 50. The lateral surface of the connection object 60 has an R-shape at the guiding portion 65. The lateral surface extends from the end to the removal side along the insertion/removal direction, and inclines outward toward the removal side further. The connection object 60 has a layered ground 66 forming the back surface of the exterior on the back side.

Figure 5:
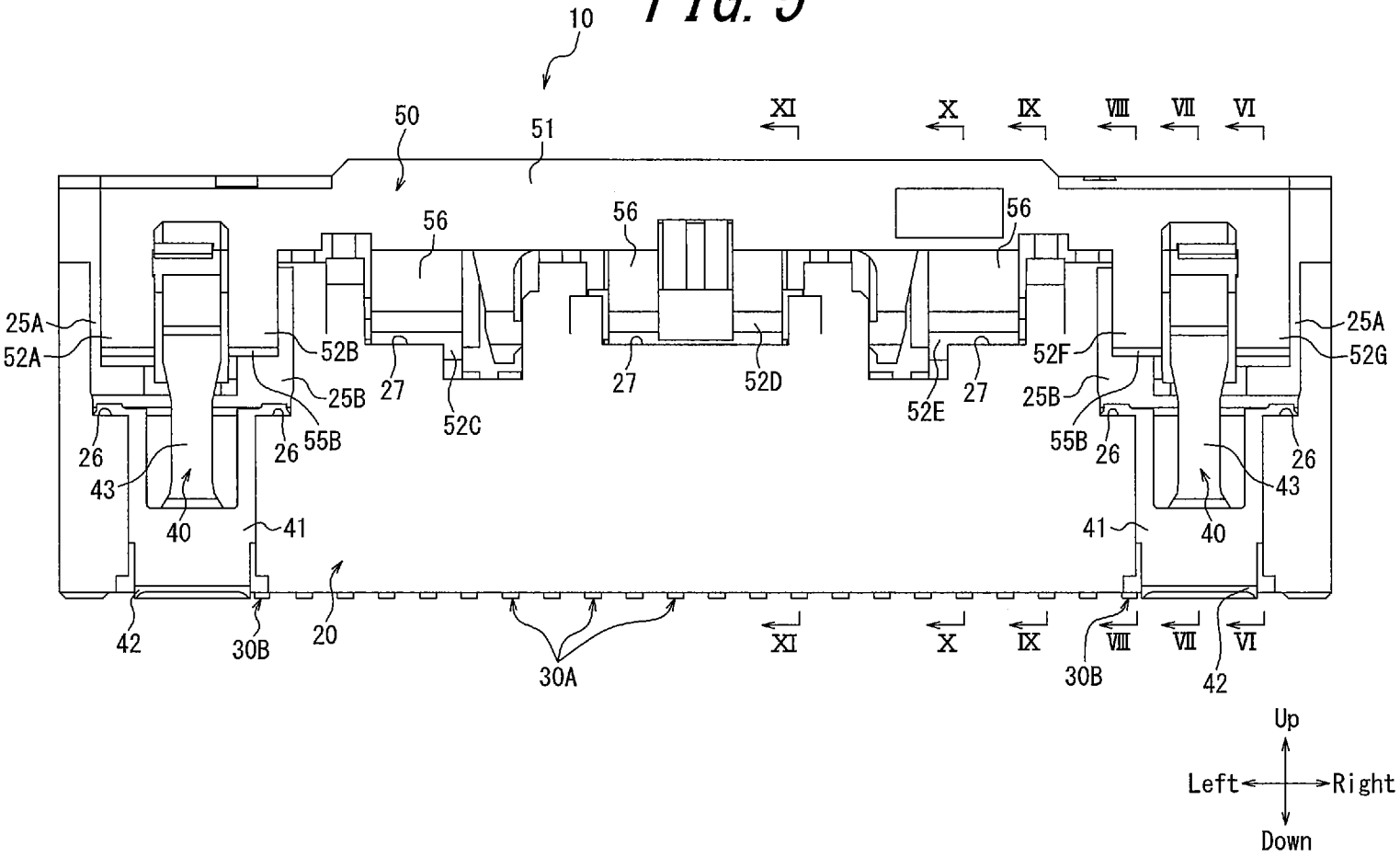
FIG. 5 is a front view of the connector in FIG. 1.
Figure 6:
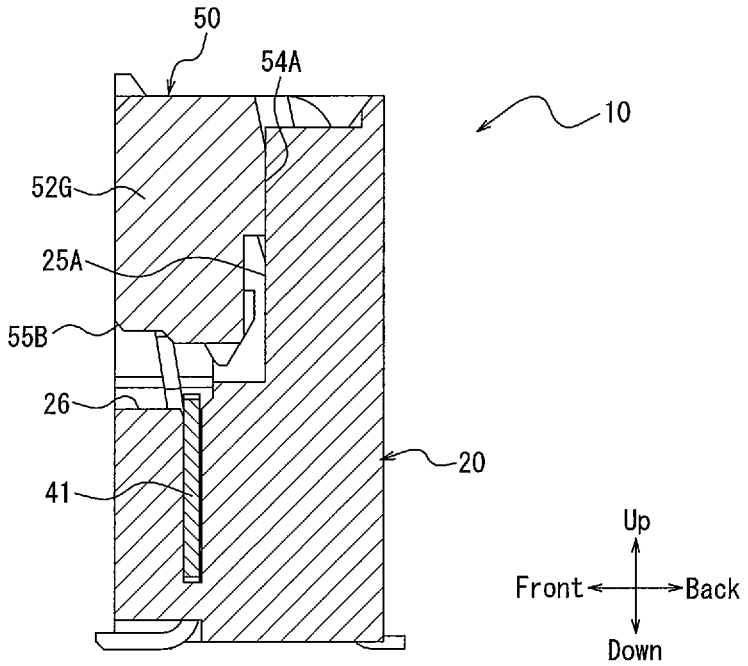
FIG. 6 is a cross-sectional view taken along arrows VI-VI in FIG. 5.
Figure 7:
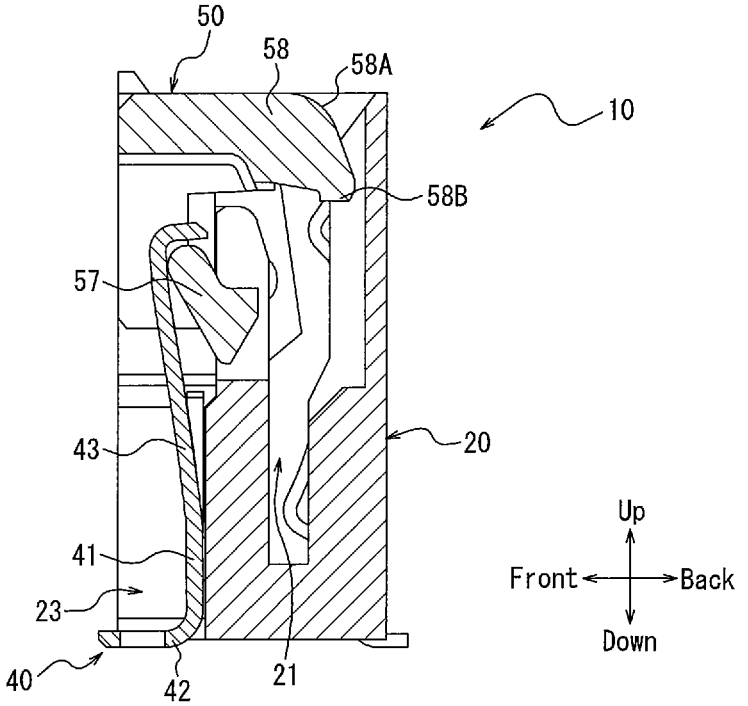
FIG. 7 is a cross-sectional view taken along arrows VII-VII in FIG. 5.
Figure 8:
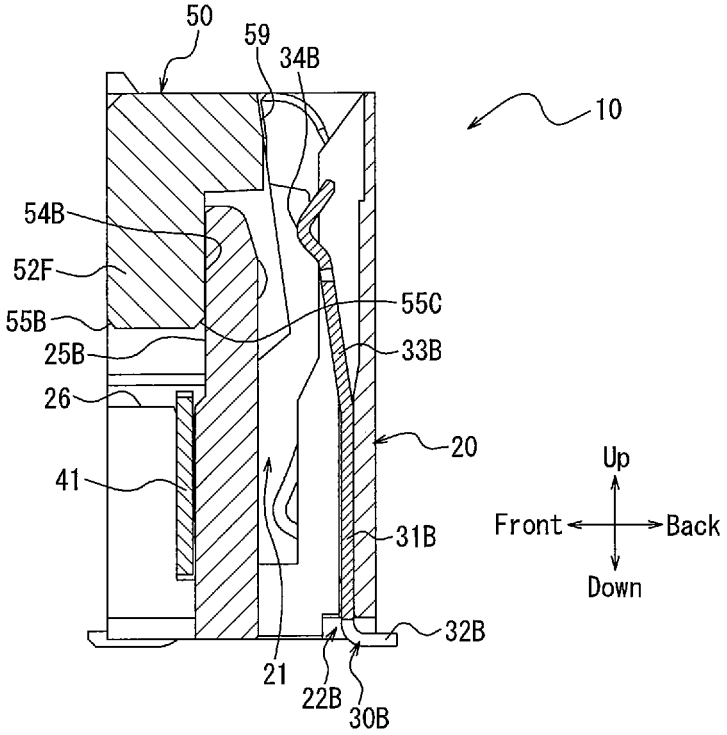
FIG. 8 is a cross-sectional view taken along arrows VIII-VIII in FIG. 5.
Figure 9:
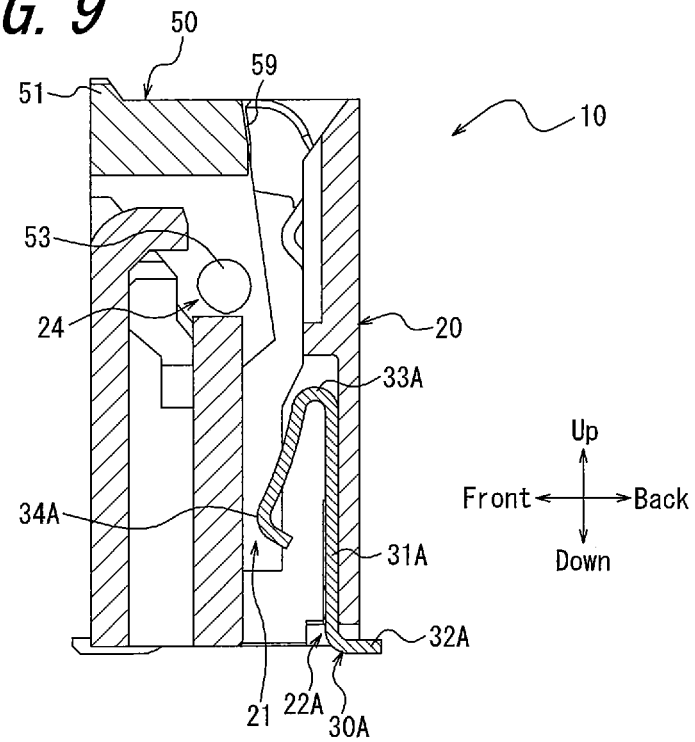
FIG. 9 is a cross-sectional view taken along arrows IX-IX in FIG. 5.
Figure 10:
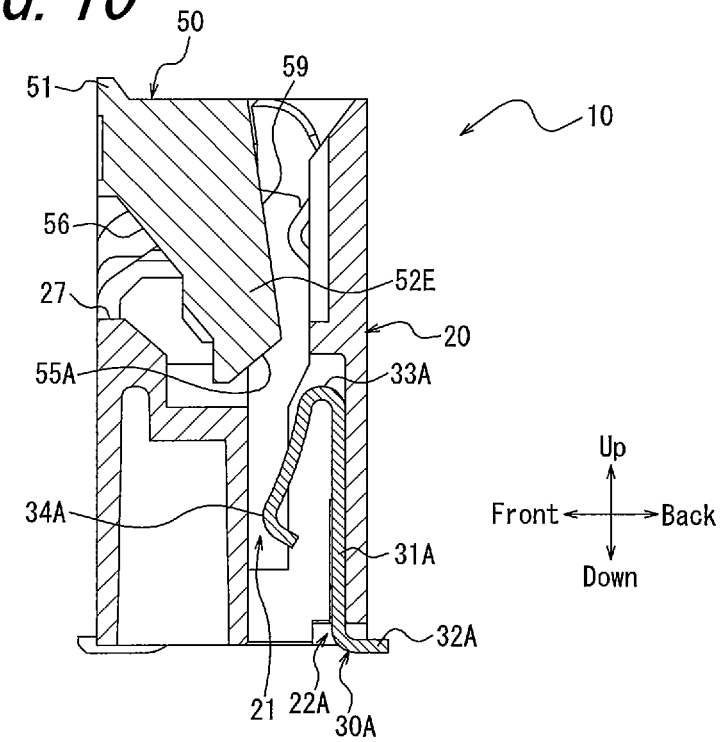
FIG. 10 is a cross-sectional view taken along arrows X-X in FIG. 5.
Figure 11:
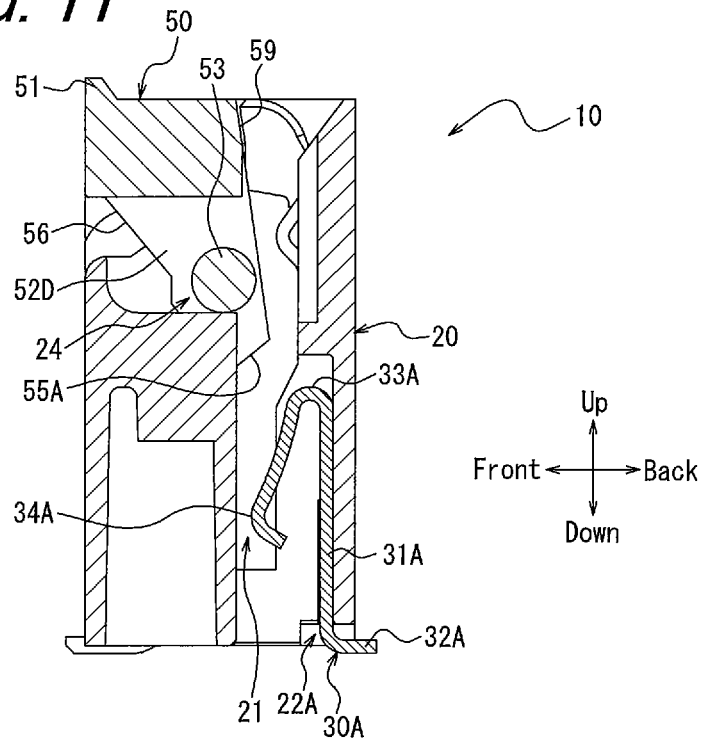
FIG. 11 is a cross-sectional view taken along arrows XI-XI in FIG. 5.

FIG. 5 is FIG. 5 is a front view of the connector in FIG. 1, FIG. 6 is a cross-sectional view taken along arrows VI-VI in FIG. 5, FIG. 7 is a cross-sectional view taken along arrows VII-VII in FIG. 5, FIG. 8 is a cross-sectional view taken along arrows VIII-VIII in FIG. 5, FIG. 9 is a cross-sectional view taken along arrows IX-IX in FIG. 5, FIG. 10 is a cross-sectional view taken along arrows X-X in FIG. 5, and FIG. 11 is a cross-sectional view taken along arrows XI-XI in FIG. 5. Function of each component of the connector 10 will be described in detail below with reference mainly to FIGS. 5 to 11.

With reference to FIGS. 9 to 11, when the first contact 30A is pressed into the first mounting groove 22A of the insulator 20, the first contact 30A is elastically deformable along the front and back direction. When the first contact 30A is in a free state where it is not elastically deformed, the contact portion 34A projects from the first mounting groove 22A and locates in the insertion groove 21. With reference to FIG. 8, when the second contact 30B is pressed into the second mounting groove 22B of the insulator 20, the second contact 30B is elastically deformable along the front and back direction. When the second contact 30B is in a free state where it is not elastically deformed, the contact portion 34B projects from the second mounting groove 22B and locates in the insertion groove 21.

With reference to FIG. 11, when the actuator 50 is attached to the insulator 20, the rotating shaft 53 of the actuator 50 is accepted by the rotating shaft receiver 24 of the insulator 20. When the rotating shaft 53 is supported by the rotating shaft receiver 24 from the insertion side, the actuator 50 is rotatable between a closed position where the actuator 50 closes with respect to the insulator 20 and an opened position where the actuator 50 opens with respect to the insulator 20. In the connector 10 according to an embodiment, when the actuator 50 moves from the closed position to the opened position, it rotates from the removal side to the insertion side with respect to the insulator 20. When the actuator 50 moves from the closed position to the opened position, it rotates counterclockwise in FIGS. 6 to 11.

With reference to FIG. 7, when the actuator 50 is attached from above to the insulator 20 into which the pressing member 40 is pressed, the elastic portion 43 of the pressing member 40 elastically deforms forward by a slope that forms the front surface of the cam 57 of the actuator 50. When the elastic portion 43 elastically displaces forward, the cam 57 enters further into the insertion side than the end having a substantially L-shape of the elastic portion 43, and the elastic portion 43 and the cam 57 are engaged with each other. Then, the slightly and elastically deformed end of the elastic portion 43 of the pressing member 40 comes in contact with the cam 57 of the actuator 50 from front. As a result, an urging force acts on the actuator 50 through the cam 57, and the pressing member 40 urges the actuator 50 to rotate toward the closed position. The pressing member 40 elastically deforms and allows the actuator 50 to rotate to the opened position side.

With reference to FIG. 6, when the actuator 50 is located in the closed position, the first closed position regulating portion 25A of the insulator 20 and the first closed position regulated portion 54A of the actuator 50 come in contact or come close to each other. In the same manner, with reference to FIG. 8, when the actuator 50 is located in the closed position, the second closed position regulating portion 25B of the insulator 20 and the second closed position regulated portion 54B of the actuator 50 come in contact or come close to each other. The first closed position regulating portion 25A and the second closed position regulating portion 25B of the insulator 20 apply a drag that balances with the urging force acting from the pressing member 40 on the actuator 50 to the actuator 50. The first closed position regulating portion 25A and the second closed position regulating portion 25B define the closed position of the actuator 50 and serve to prevent the actuator 50 from rotating excessively over the closed position.

Figure 12:
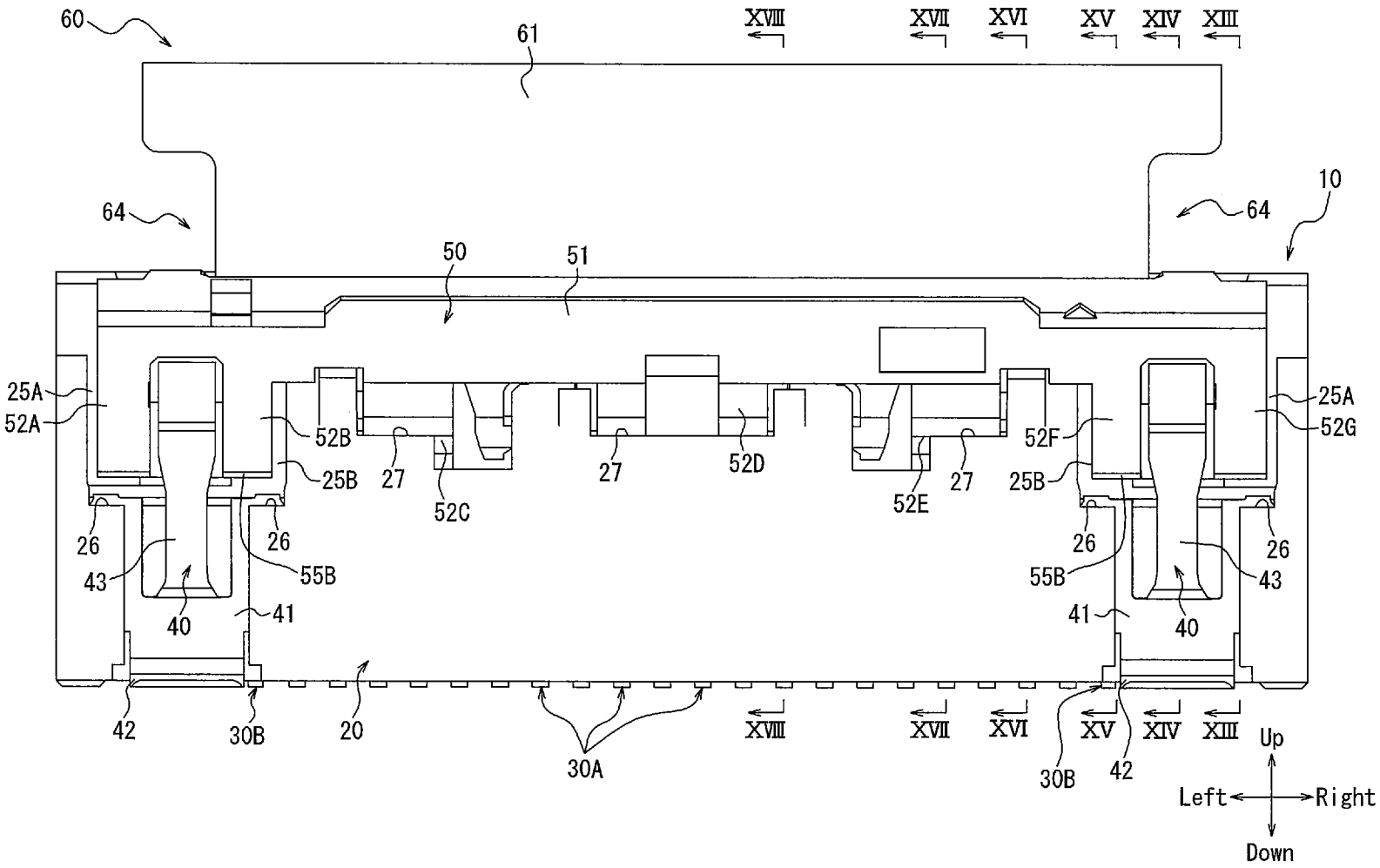
FIG. 12 is a front view of the connector in FIG. 1 when the connection object is inserted.
Figure 13:
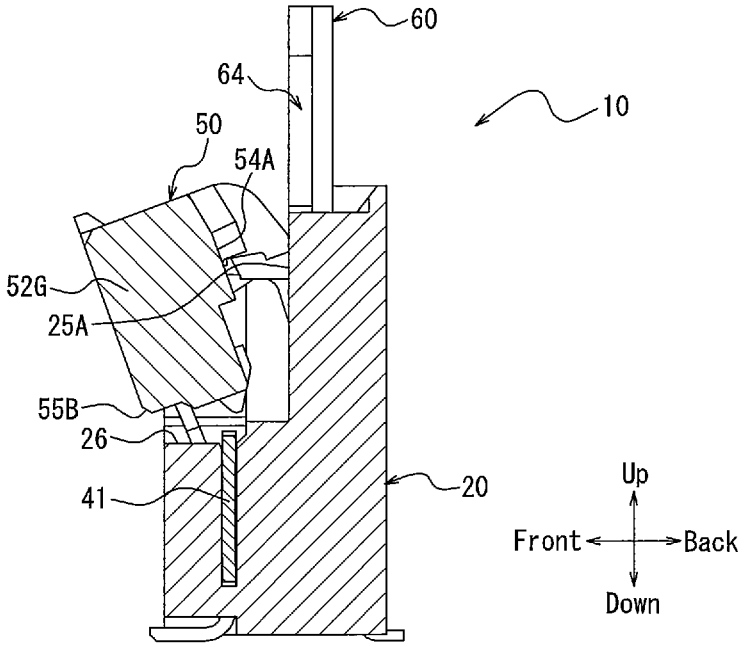
FIG. 13 is a cross-sectional view taken along arrows XIII-XIII in FIG. 12.
Figure 14:
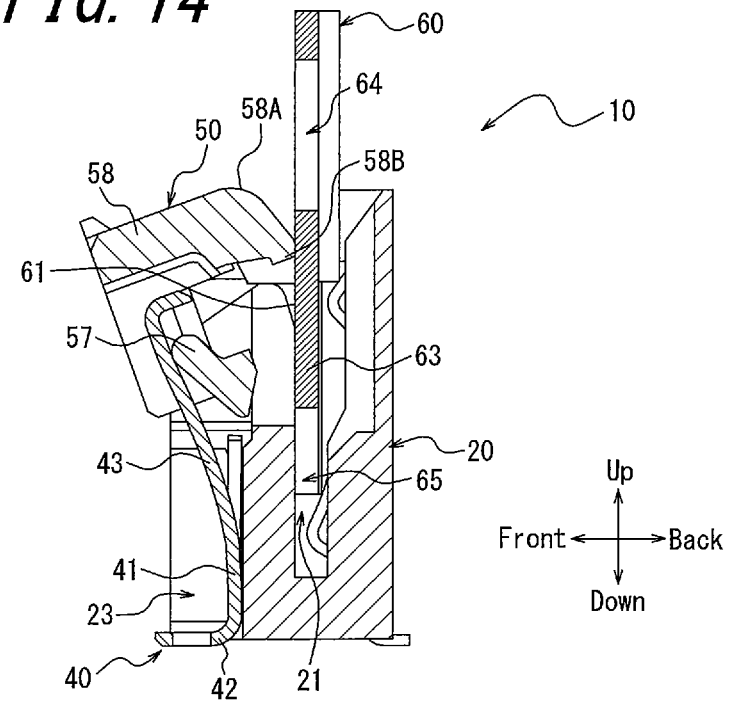
FIG. 14 is a cross-sectional view taken along arrows XIV-XIV in FIG. 12.
Figure 15:
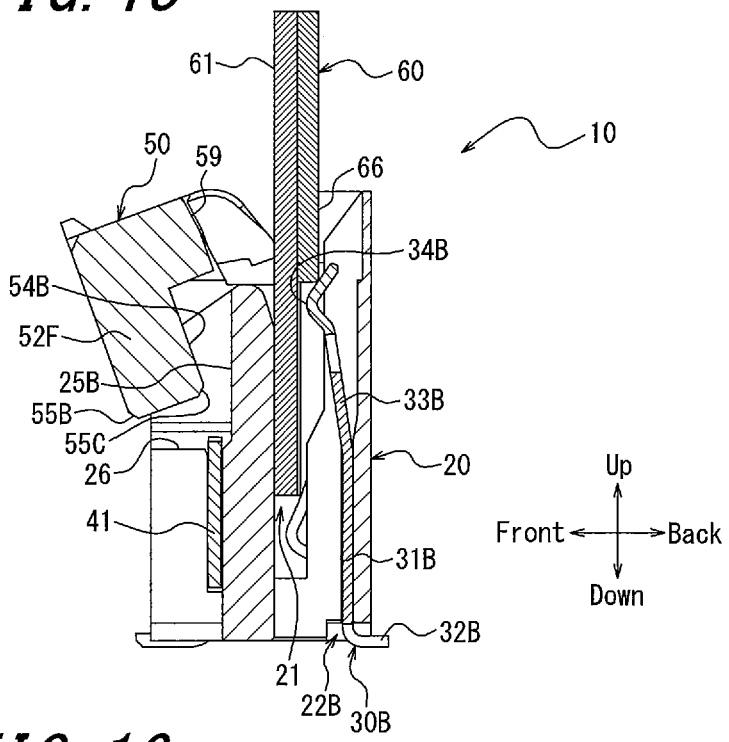
FIG. 15 is a cross-sectional view taken along arrows XV-XV in FIG. 12.
Figure 16:
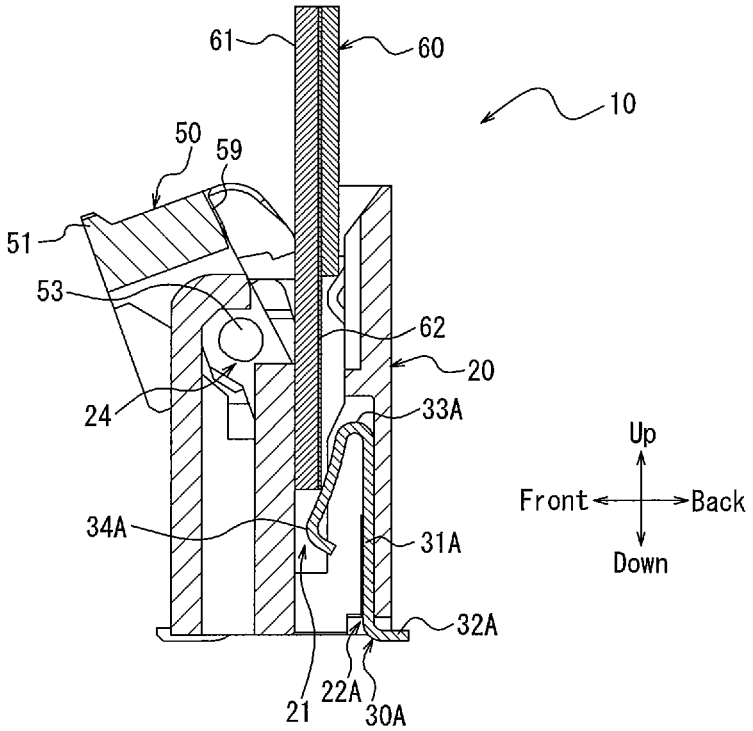
FIG. 16 is a cross-sectional view taken along arrows XVI-XVI in FIG. 12.
Figure 17:
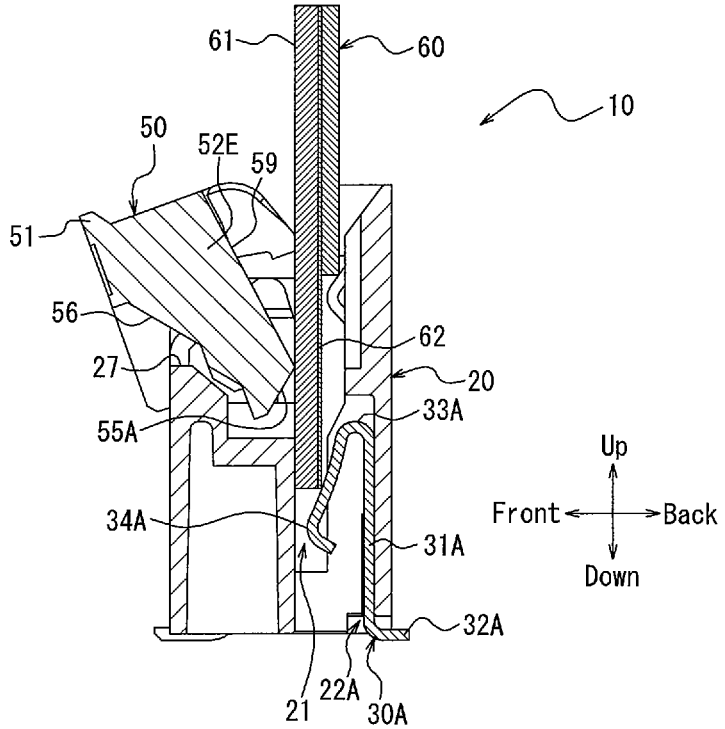
FIG. 17 is a cross-sectional view taken along arrows XVII-XVII in FIG. 12.
Figure 18:
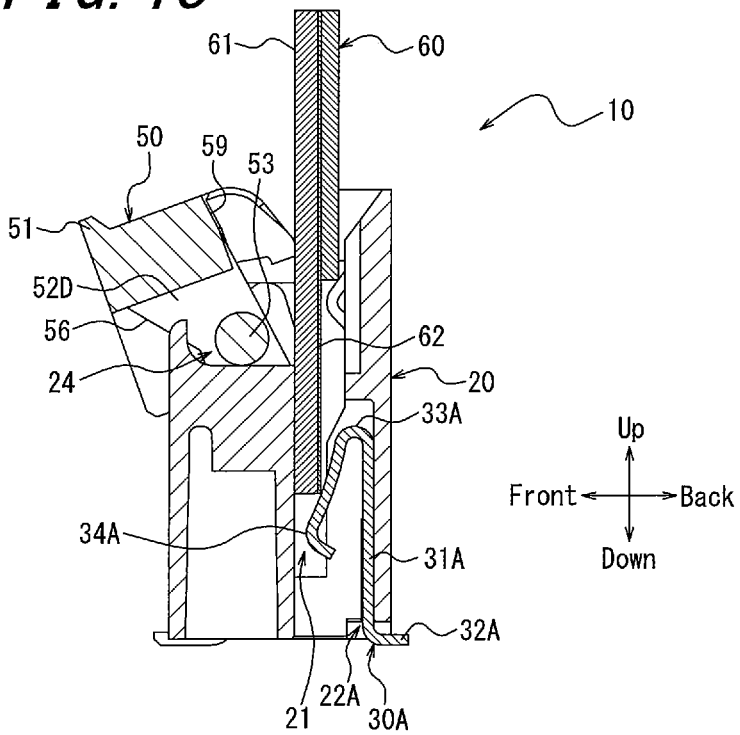
FIG. 18 is a cross-sectional view taken along arrows XVIII-XVIII in FIG. 12.

FIG. 12 is a front view of the connector in FIG. 1 when the connection object is inserted, FIG. 13 is a cross-sectional view taken along arrows XIII-XIII in FIG. 12, FIG. 14 is a cross-sectional view taken along arrows XIV-XIV in FIG. 12, FIG. 15 is a cross-sectional view taken along arrows XV-XV in FIG. 12, FIG. 16 is a cross-sectional view taken along arrows XVI-XVI in FIG. 12, FIG. 17 is a cross-sectional view taken along arrows XVII-XVII in FIG. 12 and FIG. 18 is a cross-sectional view taken along arrows XVIII-XVIII in FIG. 12. Function of each component when the connection object 60 is inserted into the connector 10 will be described in detail below with reference mainly to FIGS. 12 to 18.

When the connection object 60 is inserted into the connector 10, the end of the reinforcing portion 61 of the connection object 60 enters into the insertion groove 21 along a slope formed at the upper edge on the back surface of the insertion groove 21. In this case, even if the insertion position of the connection object 60 is slightly misaligned with respect to the insertion groove 21, the end of the reinforcing portion 61 slides over the slope of the insertion groove 21, and as a result the connection object 60 is guided into the insertion groove 21. In the same manner, even if the insertion position of the connection object 60 is slightly misaligned in the right and left direction with respect to the insertion groove 21 or even if the connection object 60 is slightly inclined to the right and left from the insertion/removal direction, the lateral surface of the connection object 60 at the guiding portion 65 slides on the inner surface of the locking portion 58 of the actuator 50, and the connection object 60 is guided into the insertion groove 21. More specifically, the inclined lateral surface of the connection object 60 forming the guiding portion 65 allows the connection object 60 to move from the outside to the inside in the right and left direction with the insertion groove 21 as a reference.

When the connection object 60 moves further to the insertion side of the insertion groove 21, the contact portion 63 of the connection object 60 and the locking portion 58 of the actuator 50 come in contact with each other. The external surface on the removal side of the locking portion 58 is formed of the curve 58A having an R-shape, and drag is generated toward the opened position of the actuator 50 due to contact between the locking portion 58 and the connection object 60. Therefore, a moment of force toward the opened position is generated with respect to the actuator 50. When the connection object 60 moves further toward the insertion side of the insertion groove 21 with the locking portion 58 and the contact portion 63 being in contact with each other, as illustrated in FIG. 14, the actuator 50 moves forward with respect to the insulator 20 and rotates to the opened position side by the moment of force toward the opened position. On the other hand, when the actuator 50 moves forward and rotates to the opened position, the pressing member 40 elastically deforms and an urging force toward the closed position acts on the actuator 50 through the cam 57. Therefore, the locking portion 58 of the actuator 50 rides over the front surface of the contact portion 63 of the connection object 60. The contact portion 63 slides with respect to the end portion of the locking portion 58 as the connection object 60 moves to the insertion side.

With reference to FIG. 18, rotating shafts 53 projected respectively from the right and left sides of the projection 52D are supported by the rotating shaft receiver 24 of the insulator 20 from the insertion side. The actuator 50 is supported by the insulator 20 from the insertion side to the removal direction.

With reference to FIGS. 16 to 18, the back surface of the signal line 62 of the connection object 60 comes in contact with the contact portion 34A of the first contact 30A and elastically deforms the first contact 30A to the inside of the first mounting groove 22A. In the same manner, with reference to FIG. 15, the ground 66 of the connection object 60 comes in contact with the contact portion 34B of the second contact 30B and elastically deforms the second contact 30B toward the inside of the second mounting groove 22B.

Figure 19:
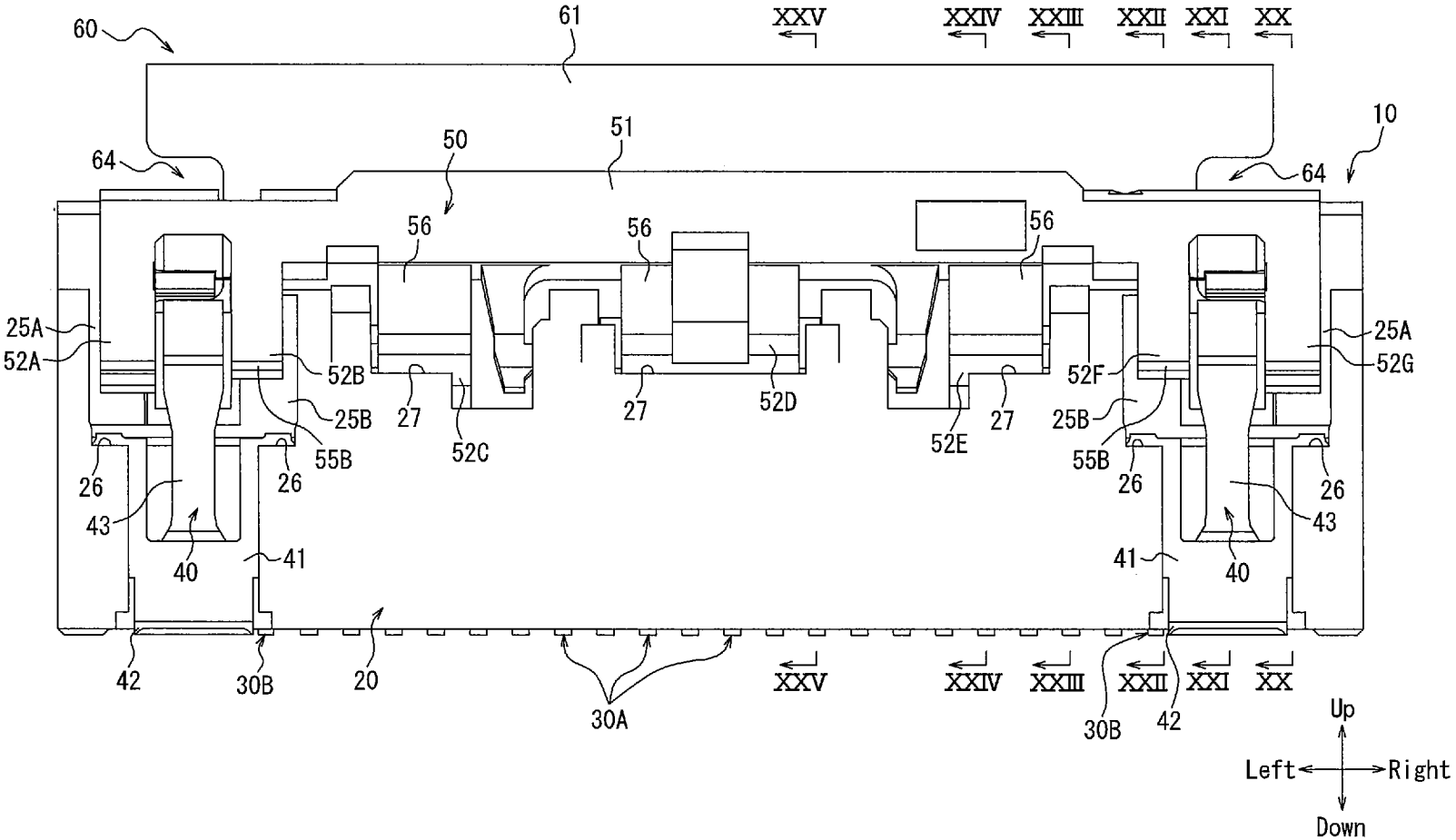
FIG. 19 is a front view of the connector in FIG. 1 when the connection object is completely inserted.
Figure 20:
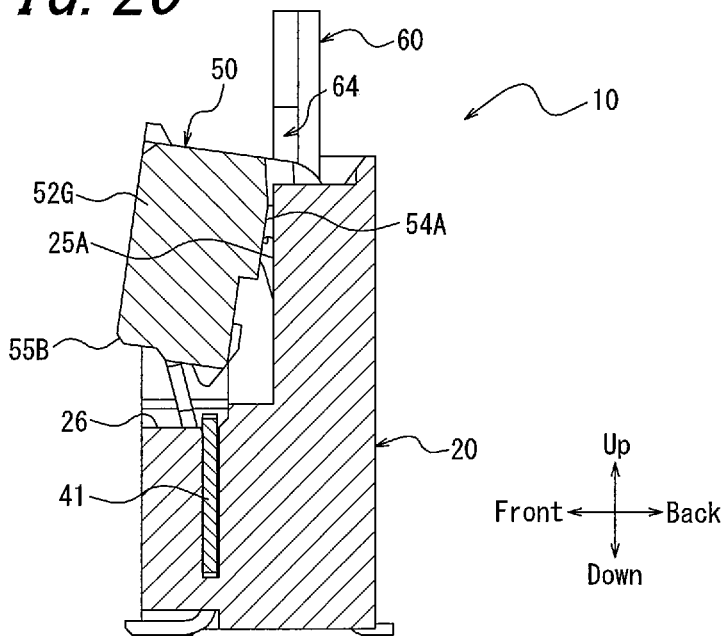
FIG. 20 is a cross-sectional view taken along arrows XX-XX in FIG. 19.
Figure 21:
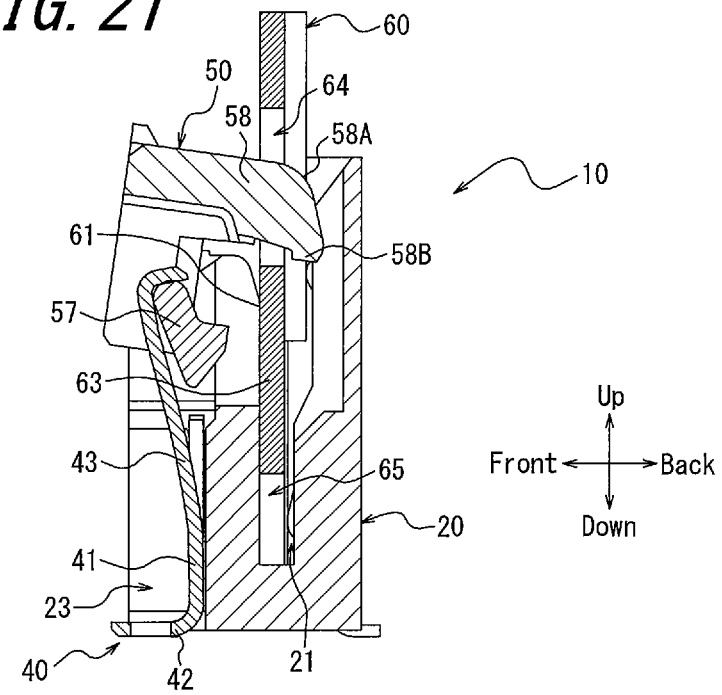
FIG. 21 is a cross-sectional view taken along arrows XXI-XXI in FIG. 19.
Figure 22:
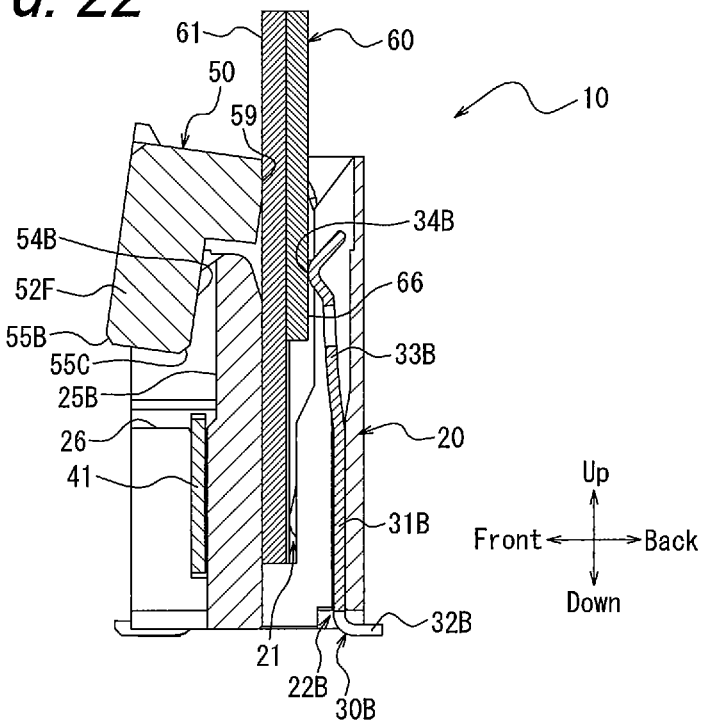
FIG. 22 is a cross-sectional view taken along arrows XXII-XXII in FIG. 19.
Figure 23:
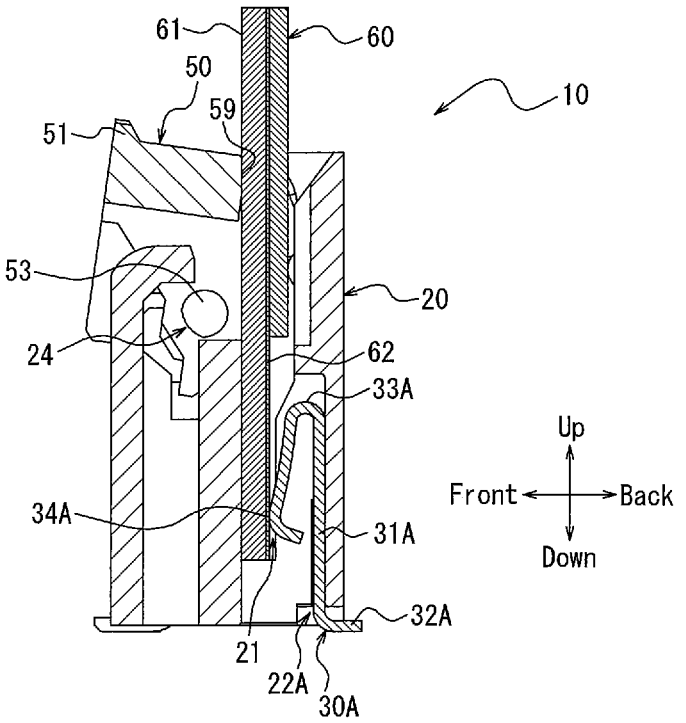
FIG. 23 is a cross-sectional view taken along arrows XXIII-XXIII in FIG. 19.
Figure 24:
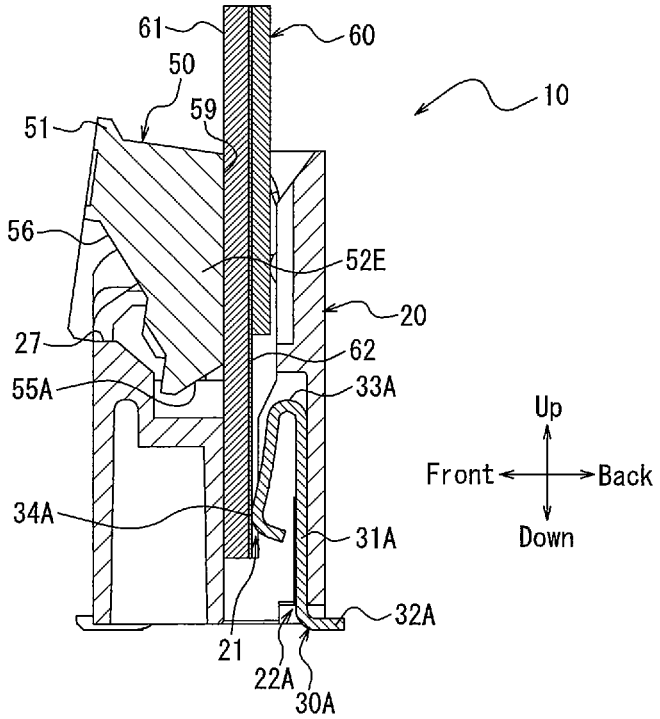
FIG. 24 is a cross-sectional view taken along arrows XXIV-XXIV in FIG. 19.
Figure 25:
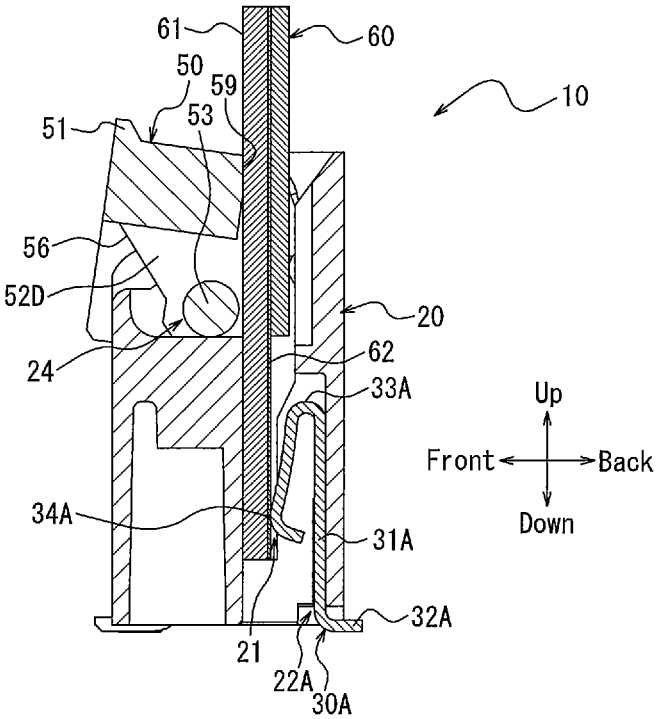
FIG. 25 is a cross-sectional view taken along arrows XXV-XXV in FIG. 19.

FIG. 19 is a front view of the connector in FIG. 1 when the connection object is completely inserted, FIG. 20 is a cross-sectional view taken along arrows XX-XX in FIG. 19, FIG. 21 is a cross-sectional view taken along arrows XXI-XXI in FIG. 19, FIG. 22 is a cross-sectional view taken along arrows XXII-XXII in FIG. 19, FIG. 23 is a cross-sectional view taken along arrows XXIII-XXIII in FIG. 19, FIG. 24 is a cross-sectional view taken along arrows XXIV-XXIV in FIG. 19, and FIG. 25 is a cross-sectional view taken along arrows XXV-XXV in FIG. 19. Function of each component when the connection object 60 is completely inserted into the connector 10 will be described in detail below with reference mainly to FIGS. 19 to 25.

With reference to FIG. 21, when the connection object 60 is completely inserted into the insertion groove 21, the contact portion 63 of the connection object 60 passes the locking portion 58 of the actuator 50 and is completely accommodated in the insertion groove 21. Then, the locking portion 58 and the contact portion 63 come in no contact with each other, and the actuator 50 automatically moves to the lock position by the urging force from the pressing member 40. The lock position refers to the position of the actuator 50 for retaining the connection object 60 inserted into the insertion groove 21. Comparing FIGS. 6 to 11 with FIGS. 20 to 25, respectively, at the lock position, the actuator 50 moves to a position which is a little bit in front of the closed position and slightly inclines toward the connection object 60 so that the removal side comes close to the connection object 60. At the lock position, the locking portion 58 of the actuator 50 engages with the locked portion 64 of the connection object 60. The connection object 60 is retained in the insertion groove 21 due to the engagement between the locking portion 58 and the locked portion 64. In this state, even if the connection object 60 is forced to be removed, the contact portion 63 of the connection object 60 comes in contact with the hook 58B of the locking portion 58 and generates a moment of force toward the closed position with respect to the actuator 50. Therefore, a moment of force toward the opened position with respect to the actuator 50 that is about to rotate to the opened position associated with removal of the connection object 60 is suppressed. As a result, the connection object 60 is retained more effectively.

In this manner, the connector 10 retains the connection object 60 with only one operation in which the connection object 60 is inserted, without requiring an operator or an assembly apparatus to perform any operation of the actuator 50. When the actuator 50 is located at the lock position, the slope forming the front surface of the cam 57 of the actuator 50 is disposed along the back surface of the elastic portion 43 of the pressing member 40. Therefore, the cam 57 receives an urging force from the elastic portion 43 in any aspect such as point contact, line contact and surface contact. With reference to FIGS. 22 to 25, in this case, due to the urging force toward the closed position received from the pressing member 40, the actuator 50 presses the connection object 60 backward through the pressing portion 59.

With reference to FIGS. 23 to 25, the contact portion 34A and the signal line 62 of the connection object 60 come in contact with each other with the first contact 30A elastically deformed. In the same manner, with reference to FIG. 22, the contact portion 34B and the ground 66 of the connection object 60 come in contact with each other with the second contact 30B elastically deformed. As a result, the circuit board CB on which the connector 10 is mounted and the connection object 60 are electrically connected to each other through the first contact 30A and the second contact 30B. When the contact portion 34B and the ground 66 come in contact with each other, the connection object 60 is grounded to the circuit board CB through the connector 10. In this manner, when the ground 66 is formed on a position different from a position of the signal line 62 and is grounded to the circuit board CB, noise can be reduced also during high-speed transmission.

Figure 26:
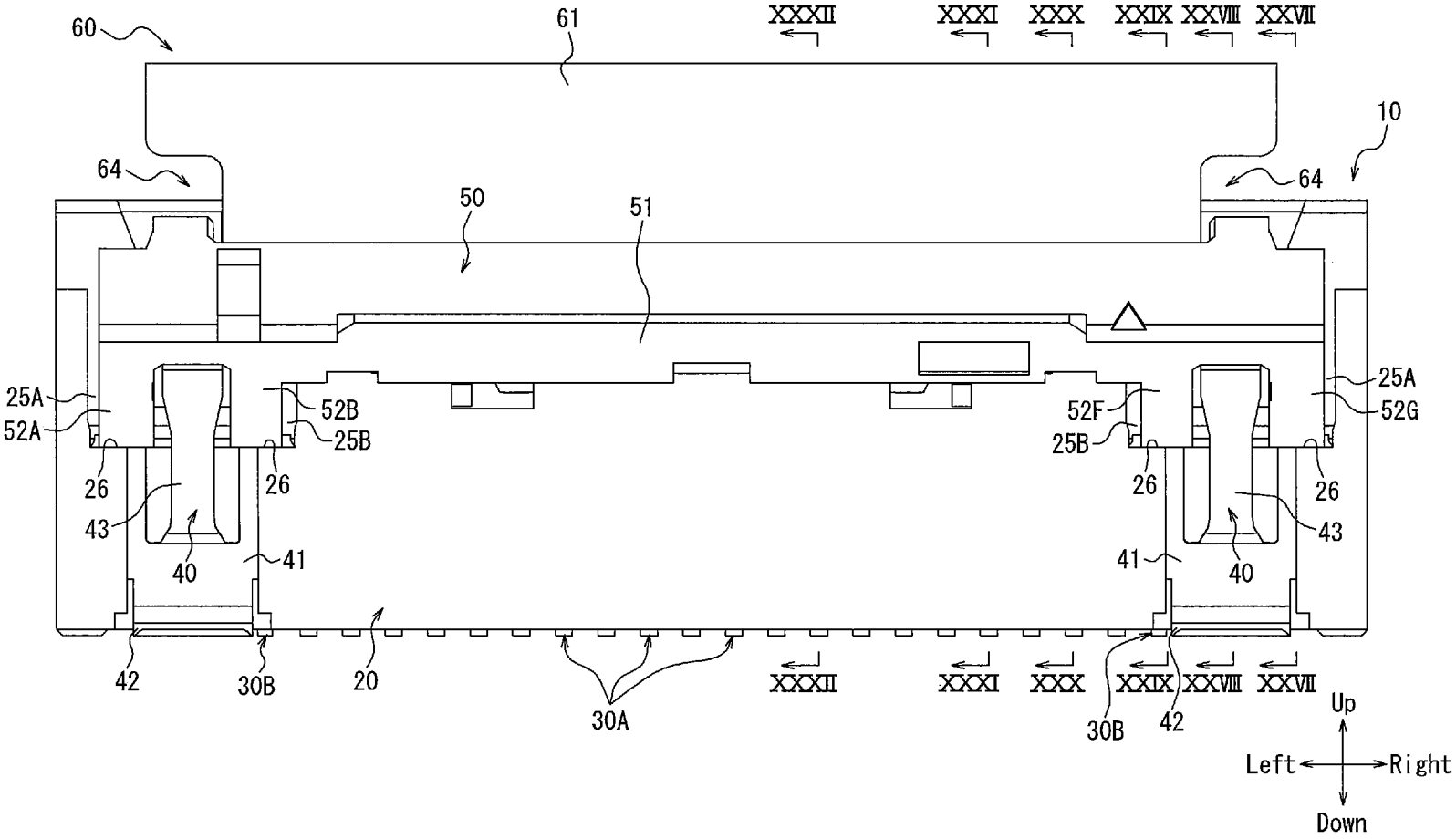
FIG. 26 is a front view of the connector in FIG. 1 when the connection object is removed.
Figure 27:
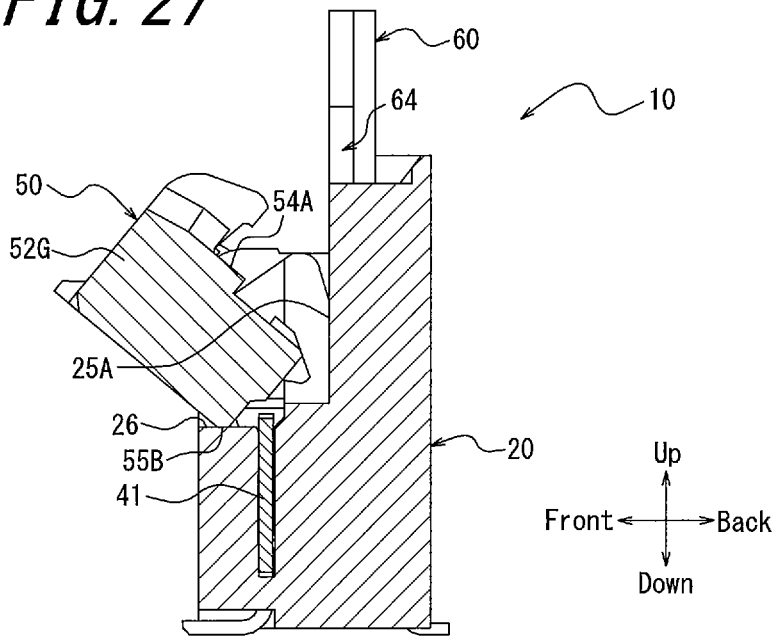
FIG. 27 is a cross-sectional view taken along arrows XXVII-XXVII in FIG. 26.
Figure 28:
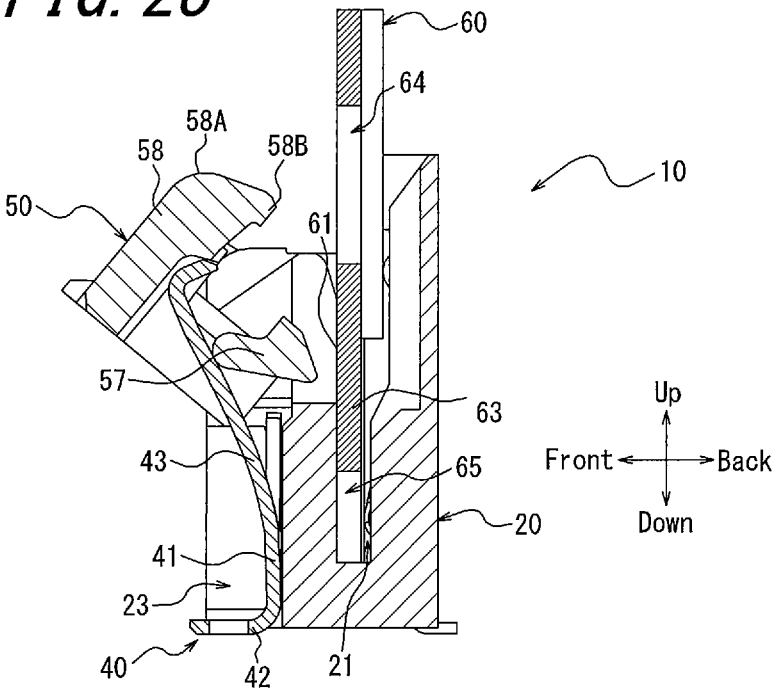
FIG. 28 is a cross-sectional view taken along arrows XXVIII-XXVIII in FIG. 26.
Figure 29:
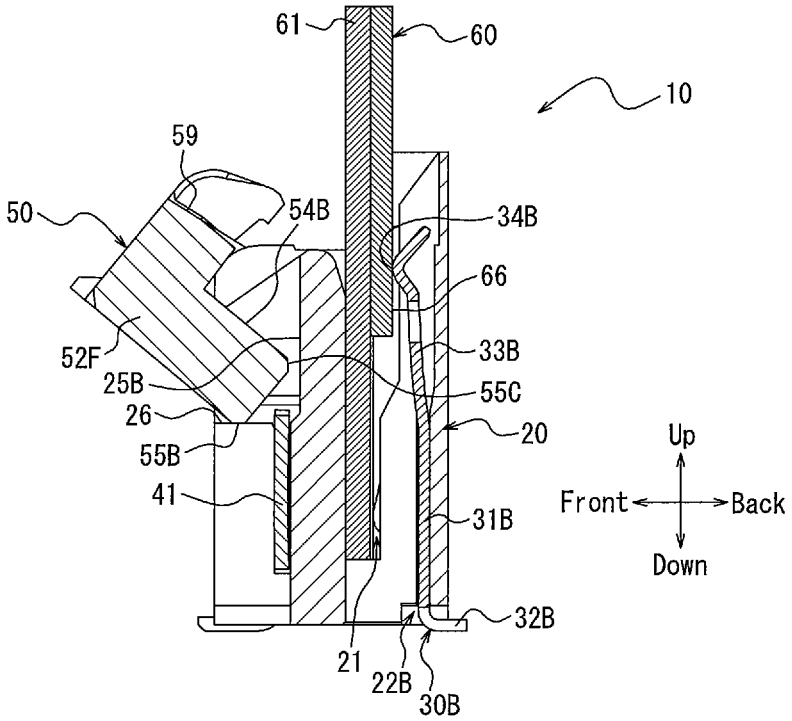
FIG. 29 is a cross-sectional view taken along arrows XXIX-XXIX in FIG. 26.
Figure 30:
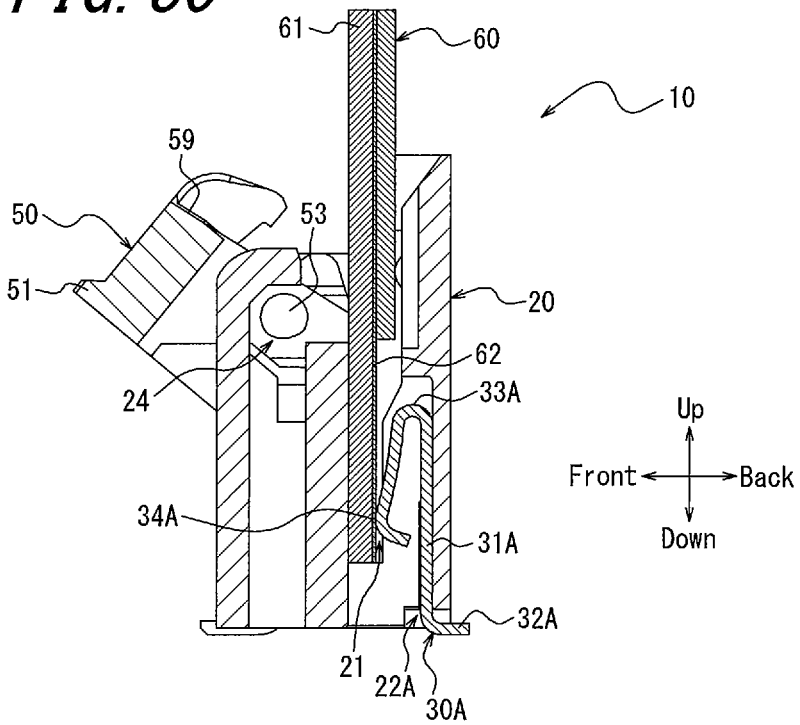
FIG. 30 is a cross-sectional view taken along arrows XXX-XXX in FIG. 26.
Figure 31:
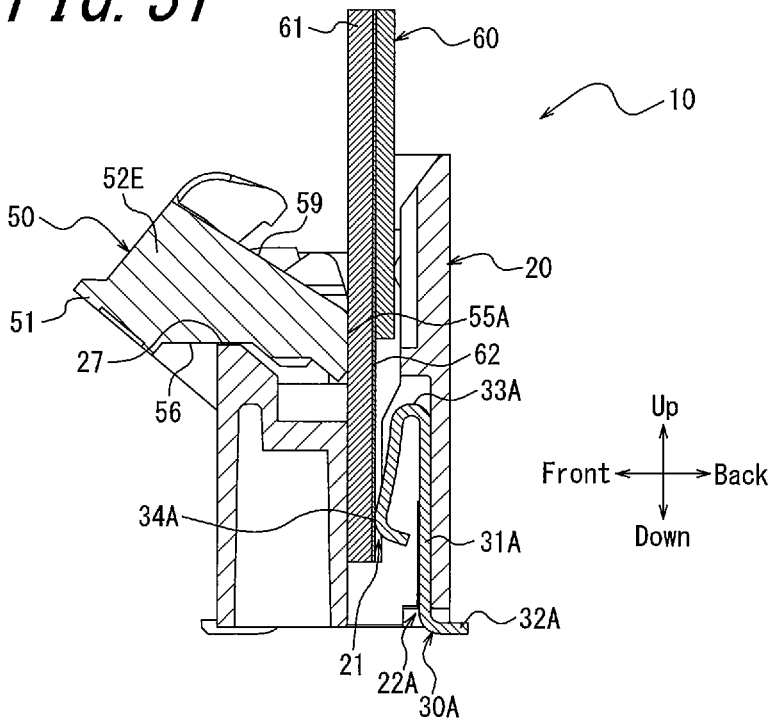
FIG. 31 is a cross-sectional view taken along arrows XXXI-XXXI in FIG. 26.
Figure 32:
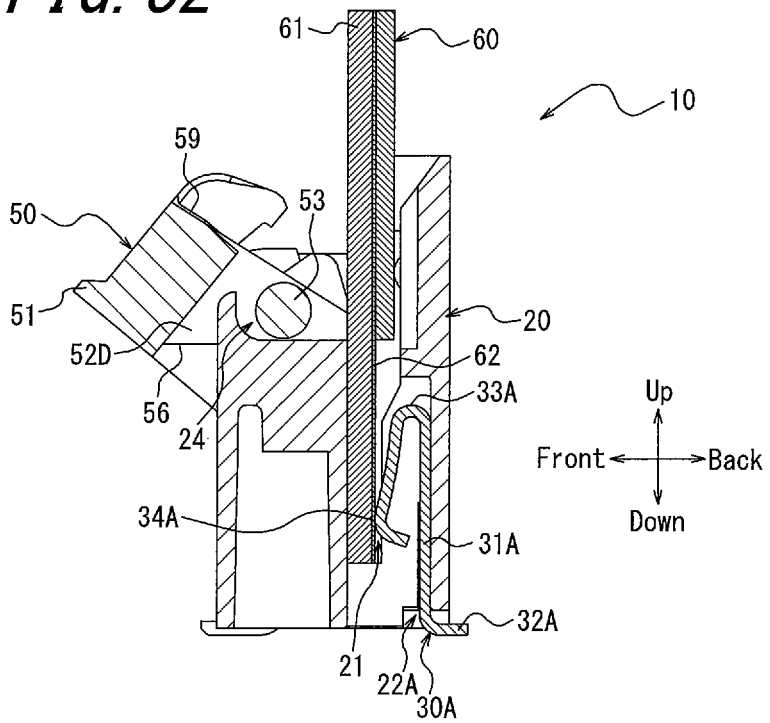
FIG. 32 is a cross-sectional view taken along arrows XXXII-XXXII in FIG. 26.

FIG. 26 is a front view of the connector in FIG. 1 when the connection object is removed, FIG. 27 is a cross-sectional view taken along arrows XXVII-XXVII in FIG. 26, FIG. 28 is a cross-sectional view taken along arrows XXVIII-XXVIII in FIG. 26, FIG. 29 is a cross-sectional view taken along arrows XXIX-XXIX in FIG. 26, FIG. 30 is a cross-sectional view taken along arrows XXX-XXX in FIG. 26, FIG. 31 is a cross-sectional view taken along arrows XXXI-XXXI in FIG. 26 and FIG. 32 is a cross-sectional view taken along arrows XXXII-XXXII in FIG. 26. Function of each component when the connection object 60 is removed from the connector 10 will be described in detail below with reference mainly to FIGS. 26 to 32.

In the connector 10, when an operator or an assembly apparatus operates the operating portion 51 of the actuator 50 to rotate the actuator 50 to the opened position with the connection object 60 completely inserted into the insertion groove 21, the actuator 50 holds the opened position independently. With reference to FIG. 28, when the actuator 50 is located at the opened position, the pressing member 40 elastically deforms significantly and an urging force toward the closed position acts on the actuator 50 through the cam 57. On the other hand, with reference to FIG. 31, when the actuator 50 is located at the opened position, the first holding portion 55A of the actuator 50 comes in contact with the front surface of the reinforcing portion 61 of the connection object 60 inserted into the insulator 20. Then, an urging force acting on the actuator 50 from the elastic portion 43 of the pressing member 40 through the cam 57 and a drag acting on the actuator 50 from the front surface of the reinforcing portion 61 of the connection object 60 through the first holding portion 55A are balanced, and as a result a moment of force is cancelled. Therefore, rotation of the actuator 50 is suppressed, and the actuator 50 holds the opened position independently. In order to cancel a moment of force in the aforementioned manner to effectively suppress the rotation of the actuator 50, when the actuator 50 is located at the opened position, the contacts between the rotating shaft 53, the first holding portion 55A and the cam 57 of the actuator 50 and the pressing member 40 are respectively located at substantially the same position in the insertion/removal direction.

With reference to FIGS. 27 to 29, when the actuator 50 is located at the opened position, the second holding portion 55B of the actuator 50 is located further on the insertion side than the cam 57 and comes in contact with the supporting portion 26 of the insulator 20, and as a result, the actuator 50 is supported by the insulator 20 along the insertion/removal direction from the insertion side.

With reference to FIG. 31, when the actuator 50 is located at the opened position, the open position regulated portion 56 of the actuator 50 comes in contact with or comes in close to the open position regulating portion 27 of the insulator 20. The open position regulating portion 27 serves to define the opened position of the actuator 50 and to prevent the actuator 50 from excessively rotating over the opened position. As a result of this, the open position regulating portion 27 can prevent each member such as the insulator 20 and the actuator 50 from being damaged.

When the connection object 60 is removed with the actuator 50 located at the opened position, after the front surface of the reinforcing portion 61 of the connection object 60 slides relative to the first holding portion 55A of the actuator 50, the first holding portion 55A and the connection object 60 come in no contact with each other. Then, the actuator 50 moves slightly backward from the opened position illustrated in FIGS. 27 to 32, and the pivot 55C illustrated in FIG. 29 comes in contact with the second closed position regulating portion 25B of the insulator 20. The actuator 50 automatically returns to the closed position about the pivot 55C by an urging force from the pressing member 40.

According to the connector 10 of an embodiment described above, the usability during removal of the connection object 60 is improved. In the case of a conventional connector in which the actuator 50 cannot hold the opened position independently, it is necessary for an operator or an assembly apparatus, during removal of the connection object, to rotate the actuator to the opened position and hold the actuator to the opened position and at the same time to remove the connection object from the connector. For example, an operator is required to operate with both hands. An assembly apparatus is required to operate with two working arms, for example. In the connector 10 according to an embodiment, the actuator 50 holds the opened position independently, and thus it is not necessary for an operator or an assembly apparatus to hold the actuator 50 at the opened position during removal of the connection object 60. For example, an operator may, after rotating the actuator 50 to the opened position with one hand, remove the connection object 60 from the connector 10 with the same hand. An assembly apparatus may, after rotating the actuator 50 to the opened position by using one working arm, for example, remove the connection object 60 from the connector 10 by using the same working arm.

The actuator 50 rotates from the removal side to the insertion side when moving from the closed position to the opened position. As a result a working space where the actuator 50 is operated on the circuit board CB can be reduced. Here, as for a conventional connector in which an actuator rotates from the insertion side to the removal side, the insertion/removal direction of the connection object with respect to the connector is in parallel to the circuit board, and when the connector is mounted on the end of the circuit board, the opening of the insertion groove faces outward of the circuit board, for example. In this case, the operating portion of the actuator is disposed inside the circuit board. Therefore, it is necessary for an operator or an assembly apparatus to operate the actuator inside the circuit board. Thus, a working space is needed in a region inside of the connector on the circuit board. Since a lot of electrical components other than the connector are disposed on the circuit board, it may be difficult to secure such a working space. On the other hand, in the connector 10 according to an embodiment, even if it is disposed in the same manner as the conventional connector, the operating portion 51 of the actuator 50 is disposed on the end of the circuit board CB and faces outward. Therefore, an operator or an assembly apparatus can operate the actuator 50 outside the circuit board CB. As a result, a working space on the circuit board CB is not required. In this manner, the connector 10 can contribute to space saving on the circuit board CB.

In the case of the conventional connector in which the actuator rotates from the insertion side to the removal side, it is difficult to dispose the connector such that the connector and the connection object are connected vertical to the circuit board. On the other hand, when the actuator 50 rotates from the removal side to the insertion side when moving from the closed position to the opened position, the connector 10 according to an embodiment can be both vertical to and in parallel to the direction of connecting with the connection object 60 with respect to the circuit board CB.

When the connection object 60 is removed from the insulator 20, the actuator 50 rotates and automatically returns to the closed position, and thus it is not necessary for an operator or an assembly apparatus to perform operation of returning the actuator 50 to the closed position. An operator can return the actuator 50 to the closed position with a single operation of removing the connection object 60 from the connector 10 after rotating the actuator 50 to the opened position with one hand, for example. An assembly apparatus can return the actuator 50 to the closed position with a single operation of removing the connection object 60 from the connector 10 after rotating the actuator 50 to the opened position by using a single working arm, for example.

The cam 57 to be in contact with the pressing member 40 and the first holding portion 55A to be in contact with the connection object 60 at the opened position cancel a moment of force generated at each position, and as a result the actuator 50 can stably hold the opened position. The second holding portion 55B to be in contact with the supporting portion 26 of the insulator 20 allows the actuator 50 to be stably supported from the insertion side to the removal direction at the opened position. The pivot 55C to be in contact with the insulator 20 when rotating allows the actuator 50 to rotate stably about the pivot 55C. For example, when the connection object 60 is removed, the actuator 50 can stably rotate about the pivot 55C to the closed position by an urging force from the pressing member 40.

Since the connection object 60 is retained by the locking portion 58 with only a single operation of insertion of the connection object 60, the usability of the connector 10 is improved not only when removing but also inserting the connection object 60. It is not necessary for an operator or an assembly apparatus to rotate the actuator 50 to the opened position side when the connection object 60 is inserted and to hold the state. Therefore, an operator can insert the connection object 60 into the connector 10 with one hand, for example. An assembly apparatus can insert the connection object 60 into the connector 10 with a single working arm, for example.

Since the connection object 60 has the guiding portion 65 corresponding to the shape of the locking portion 58 of the actuator 50, an insertion performance of the connection object 60 into the connector 10 is improved.

It is obvious for a person skilled in the art that the present disclosure can be realized in other specific embodiments other than the above described embodiments without departing from the spirit or the essential characteristics thereof. Therefore the above description is merely an example and the present disclosure is not limited thereto. The scope of the invention is defined not only by the above description, but also defined by the accompanied claims. Some changes within the scope of equivalents of all changes are included therein.

For example, the shape, the disposition, the number and the like of each of the aforementioned components are not limited to those described above and illustrated in the drawings. The shape, the disposition, the number and the like of each component may have any configuration as far as each component can realize each function. The assembly method of the aforementioned connector 10 is not limited to those described above. Any assembly method can be used as far as each component is assembled such that it can exhibit its function. For example, the first contact 30A, the second contact 30B and the pressing member 40 may be integrally molded with the insulator 20 not by press-in, but by insert molding.

The aforementioned connector 10 or connection object 60 is mounted on an electronic device. Examples of electronic device include any information equipment such as a personal computer, a copying machine, a printer, a facsimile and a complex machine. Examples of electronic device include any audio and video equipment such as a liquid crystal television, a recorder, a camera and a headphone. Examples of electronic devices include any in-vehicle equipment such as a camera, a radar, a drive recorder and an engine control unit. Examples of electronic device include any in-vehicle equipment such as a car navigation system, an advanced driving support system and a security system. Furthermore examples of electronic device include any industrial equipment.

Improved usability of the connector 10 and improved insertion performance of the connection object 60 allow for improved usability during assembly of an electronic device, and manufacture of an electronic device will be facilitated.

REFERENCE SIGNS LIST

10 Connector
20 Insulator
21 Insertion groove
22A First mounting groove
22B Second mounting groove
23 Third mounting groove
24 Rotating shaft receiver
25A First closed position regulating portion
25B Second closed position regulating portion
26 Supporting portion
27 Open position regulating portion
30A First contact
30B Second contact
31A Fixing portion
31B Fixing portion
32A Mounting portion
32B Mounting portion
33A Elastic portion
33B Elastic portion
34A Contact portion
34B Contact portion
40 Pressing member
41 Fixing portion
42 Mounting portion
43 Elastic portion
50 Actuator
51 Operating portion
52, 52A, 52B, 52C, 52D, 52E, 52F, 52G Projection
53 Rotating shaft
54A First closed position regulated portion
54B Second closed position regulated portion
55A First holding portion
55B Second holding portion
55C Pivot
56 Open position regulated portion
57 Cam
58 Locking portion
58A Curve
58B Hooking portion
59 Pressing portion
60 Connection object
61 Reinforcing portion
62 Signal line
63 Contact portion
64 Locked portion
65 Guiding portion
66 Ground
CB Circuit board

The invention claimed is:

1. A connector, comprising:

an insulator into/from which a connection object can be inserted/removed; and an actuator capable of rotating between a closed position where said actuator closes with respect to said insulator and an opened position where said actuator opens with respect to said insulator, wherein said actuator rotates from a removal side to an insertion side of said connection object with respect to said insulator when moving from said closed position to said opened position and holds said opened position independently, and wherein said actuator rotates and returns to said closed position when said connection object is removed from said insulator.

2. The connector according to claim 1, comprising a pressing member configured to urge said actuator toward said closed position and to elastically deform to allow for rotation of said actuator to said opened position side, wherein said actuator includes:

a cam configured to come in contact with said pressing member; and a first holding portion configured to come in contact with said connection object inserted into said insulator at said opened position.

3. The connector according to claim 2, wherein the actuator includes a second holding portion located, at said opened position, further on an insertion side of said connection object than said cam and configured to come in contact with said insulator.

4. The connector according to claim 1, wherein said actuator includes a pivot to be in contact with said insulator when rotating.

5. The connector according to claim 1, wherein said actuator includes a locking portion configured to come in contact with said connection object when the connection object is inserted into said insulator and cause said actuator to rotate to said opened position side, and to engage with a locked portion of said connection object after being inserted.

6. An electronic device comprising a connector according to claim 1.

* * * * *